US012594460B2

(12) United States Patent
Sevelin et al.

(10) Patent No.: US 12,594,460 B2
(45) Date of Patent: Apr. 7, 2026

(54) MANAGING BLOBS FOR TRACKING OF SPORTS PROJECTILES

(71) Applicant: Topgolf Sweden AB, Danderyd (SE)

(72) Inventors: Elias Sevelin, Huddinge (SE); Lars Nyhed, Täby (SE)

(73) Assignee: Topgolf Sweden AB, Danderyd (SE)

( * ) Notice: Subject to any disclaimer, the term of this patent is extended or adjusted under 35 U.S.C. 154(b) by 0 days.

(21) Appl. No.: 18/799,552

(22) Filed: Aug. 9, 2024

(65) Prior Publication Data

US 2025/0050167 A1 Feb. 13, 2025

Related U.S. Application Data

(63) Continuation of application No. PCT/EP2024/067830, filed on Jun. 25, 2024.

(30) Foreign Application Priority Data

Aug. 10, 2023 (SE) ..... 2330350-6

(51) Int. Cl.

| | |
|---|---|
| ***A63B 24/00*** | (2006.01) |
| ***G06T 7/246*** | (2017.01) |
| ***G06V 20/52*** | (2022.01) |

(52) U.S. Cl.

CPC .. *A63B 24/0021* (2013.01); *A63B 2024/0028* (2013.01); *A63B 2220/806* (2013.01)

(58) Field of Classification Search

None

See application file for complete search history.

(56) References Cited

U.S. PATENT DOCUMENTS

| | | | | |
|---|---|---|---|---|
| 9,965,900 | B2 | 5/2018 | Wojdala et al. | |
| 10,338,209 | B2 | 7/2019 | Johnson | |
| 11,335,013 | B2 | 5/2022 | Forsgren et al. | |
| 2018/0061130 | A1 | 3/2018 | Wojdala et al. | |
| 2018/0374217 | A1 | 12/2018 | Chaurasia et al. | |
| 2019/0224552 | A1* | 7/2019 | Kiraly | A63B 24/0021 |

(Continued)

FOREIGN PATENT DOCUMENTS

| | | |
|---|---|---|
| CN | 115393373 | 11/2022 |
| JP | 6525453 | 6/2019 |
| WO | WO 2022034245 | 2/2022 |

OTHER PUBLICATIONS

International Search Report and Written Opinion in International Appln. No. PCT/EP2024/067830, mailed on Sep. 30, 2024, 20 pages.

(Continued)

*Primary Examiner* — Hung Q Dang

(74) *Attorney, Agent, or Firm* — Fish & Richardson P.C.

(57) ABSTRACT

Methods (and apparatuses) for providing blobs include capturing, by the tracking sensor, a tracking stream, which comprises tracking image frames, and assigning, by the capturing subsystem, each last blob of the set of last blobs to one or more traces to obtain a set of traces, and generating, by the capturing subsystem, a respective score for each trace of the set of traces based on one or more of a start location of said each trace, an initial straightness of said each trace, an acceleration of said each trace, a direction of said each trace, a gradually decreasing size of blobs assigned to said each trace, a length of said each trace, a blob count of said each trace, or a combination thereof.

19 Claims, 7 Drawing Sheets

(56) References Cited

U.S. PATENT DOCUMENTS

| | | | | |
|---|---|---|---|---|
| 2019/0228232 | A1* | 7/2019 | Lécart | G08G 1/0175 |
| 2019/0333541 | A1 | 10/2019 | Mack et al. | |
| 2022/0051420 | A1 | 2/2022 | Forsgren et al. | |
| 2023/0100572 | A1 | 3/2023 | Jayaram et al. | |

OTHER PUBLICATIONS

Masaki et al., "Real-time ball-position measurement using multi-view cameras for live football broadcast," Multimedia Tools and Applications, Feb. 2018, 77(18):23729-23750.
Office Action in Swedish Appln. No. 2330350-6, dated Jan. 30, 2024, 9 pages.
Extended European Search Report in European Appln No. 24193703.6, dated Nov. 25, 2024, 15 pages.

* cited by examiner

MANAGING BLOBS FOR TRACKING OF SPORTS PROJECTILES

CROSS-REFERENCE TO RELATED APPLICATIONS

This application claims the benefit of priority under 35 U.S.C. § 119(a) of Swedish Patent Application No. 2330350-6, entitled "MANAGING BLOBS FOR TRACKING OF SPORTS PROJECTILES", filed Aug. 10, 2023, and of International Application No. PCT/EP2024/067830, entitled "MANAGING BLOBS FOR TRACKING OF SPORTS PROJECTILES", filed Jun. 25, 2024.

BACKGROUND

Technical Field

The embodiments here relate to systems for tracking golf balls, such as tracking systems for broadcasting of video from a golf event, such as a competition, a driving range, or any other location where players hit golf balls. In particular, the embodiments herein relate to methods, a system, a capturing subsystem and a rendering subsystem for managing blobs, e.g. relating to a tracked object.

Description of Related Art

During a golf event, it is often desired to broadcast video from e.g. a tee, at which a player may swing a golfclub to shoot a golf ball towards e.g. a flag, a hole, out onto a range, a field or the like. Further, it is possible to also show, in the video, a trace that indicates a path of flight of the golf ball that has been hit by a player. This enhances the experience for viewers of the video.

A known setup to achieve this is a truck with video broadcasting capabilities, such as a broadcasting camera, and field equipment. The field equipment includes a video camera and a tracking sensor, such as a camera, a radar, a lidar or the like. The field equipment is connected to the truck via fiber-connections. In the truck, there are one or more servers that handle the tracking and the drawing of a trace, representing a golf ball's flight trajectory in the air, in a video stream to be broadcast. The video stream is normally captured by a broadcasting camera. The tracking sensor has a point-to-point fiber-link to the server(s) in the truck. The bandwidth of the fiber-link is 1 Gbit/s, which is sufficient to carry raw camera images and raw tracking data from the field equipment to the truck.

A problem with the known setup is that it is time-consuming to install and uninstall at a location of interest. There is thus a need for a more flexible solution.

Another problem relates to how to enable transmission of information relating to tracking, often called blob data, over a limited connection, e.g. limited in terms of bandwidth.

SUMMARY

The present inventors have realized that a problem with the fiber-based tracking and broadcast system is that the fiber-connections may be difficult to install in some situations, e.g. due to distance, difficulties with the terrain, time to install, or the like. The present inventors thus initially attempted to replace the fiber-connections with wireless connections. This would achieve a solution that would be faster to install, be independent of the terrain and when a suitable wireless communication technology is chosen, the solution would also be operable over sufficiently long distances. A wireless solution would also be more versatile, e.g. in terms of where the field equipment can be located for tracking a ball on a fairway, in a ruff, on the tee, or the like, of a golf venue, without, or almost without, any need to foresee these locations of interest due to the use of a wireless connection between the broadcasting truck and the field equipment.

However, such a wireless solution can be costly and can be dependent on availability of a cellular network, such as a 4G/5G-network. In order to achieve an even more versatile solution, the present inventors have investigated the possibility of using a radio frequency (RF) network established by the television broadcast companies that monitor a golf event, such as a golf competition, or the like. The RF-network is, however, severely limited in terms of bandwidth, especially compared to a fiber-connection. Nevertheless, it is herein presented a solution that takes advantage of the established RF-network in order to provide a more versatile solution for providing a tracking and broadcast system. Advantageously, the proposed system is easy, e.g. in terms of time consumed, to install. Moreover, use of the wireless RF-network is more cost-efficient that than establishing a separate wireless network which fulfils fulfills the bandwidth requirements. Furthermore, the embodiments herein are independent of cellular coverage, or coverage by the separate wireless network. Indeed, the embodiments herein rely on coverage by the RF-network, but such coverage is already assumed since the television broadcast system already relies on that for a geographic region, associated with the golf event to be broadcasted from, being covered.

Even with the use of the RF-network, a disadvantage may be that the same, or almost the same, tracking algorithm is first applied in the field equipment and then re-applied by the broadcasting truck. Hence, the field equipment requires—at least in terms of tracing, the same or similar resources, such as computing capability, memory etc., as in the broadcasting truck. Furthermore, the field equipment is required to process blobs forming a complete trace before sending blob data to the broadcasting truck. As a result, the transmission of blob data is delayed due to the field equipment being required to await a complete trace, e.g. resulting from the tracking algorithm applied in the field equipment.

In a more general sense, the present inventors have realized that there is a need for a reduction of the amount of data sent e.g. from a tracking sensor to a tracing system in order to consume less bandwidth. For this purpose, e.g. a blob filtering solution for reducing the amount of blob data is presented herein.

An object may hence be to eliminate, or at least reduce, the abovementioned problem and/or disadvantages.

This object, and possibly other objects, is achieved by one or more of the aspects as set forth herein.

According to an aspect, there is provided a method, e.g. performed by a video management system or a capturing subsystem, for providing blobs. The video management system can comprise a capturing subsystem, which comprises a tracking sensor. The video management system or the capturing subsystem captures, by the tracking sensor, a tracking stream, which comprises tracking image frames. The video management system or the capturing subsystem performs the following actions for each tracking image frame.

The video management system or the capturing subsystem detects, by the capturing subsystem, a set of last blobs for said each tracking image frame by applying a blob detection procedure to said each tracking image frame and one or more further tracking image frames of the tracking stream. Said each tracking image frame is subsequent to said one or more further tracking image frames.

For each last blob of the set of last blobs, the video management system or the capturing subsystem assigns, by the capturing subsystem, said each last blob to one or more traces. Thereby, a set of traces is obtained after assignment of all of the last blobs of the set of last blobs. The set of traces comprises said one or more traces assigned to said each last blob.

The video management system or the capturing subsystem generates, by the capturing subsystem, a respective score for each trace of the set of traces based on one or more of:

- a start location of said each trace,
- an initial straightness of said each trace,
- an acceleration of said each trace,
- a direction of said each trace,
- a gradually decreasing size of blobs assigned to said each trace,
- a length of said each trace,
- a blob count of said each trace, or the like, or
- a combination thereof, The video management system or the capturing subsystem selects, by the capturing subsystem, a subset of selected traces from the set of traces. Each selected trace of the subset of selected traces has the respective score that is among most extreme scores of the set of scores.

The video management system or the capturing subsystem obtains, by the capturing subsystem, a subset of last blobs based on the subset of selected traces.

Thanks to the generation of the respective score based on the various properties of said each trace as above, knowledge about expected properties for a trace of a sport projectile, such as a golf ball, is taken into account when determining which blob(s) to keep and which blob(s) to discard. Of course, the various properties refer to one or more of the start location of said each trace, the initial straightness of said each trace, the acceleration of said each trace, the direction of said each trace, the gradually decreasing size of blobs assigned to said each trace, the length of said each trace, the blob count of said each trace, and the like. An advantage with the embodiments herein is hence that the amount of blobs that needs to be transmitted to the rendering arrangement is reduced. A further advantage is that the blobs may be transferred on a more frequent basis, i.e. before a complete trace has been identified. Accordingly, blob(s) may be ready for transmission e.g. after each tracking image frame has been analyzed, or after every nth tracking image frame has been analyzed, where n may be 2, 3, 4, etc. In this manner, at least some embodiments herein enable a relaxation of the requirements on a transmission connection, such as the requirements relating to bandwidth, or capacity. Furthermore, at least some examples decreases latency, e.g. due to that less data can be sent, e.g. to the rendering subsystem, e.g. more often.

In some embodiments, the video management system or the capturing subsystem can send, by the transmitter, the subset of selected last blobs to the rendering subsystem. This means e.g. that for each frame the subset of last blobs is transmitted, where each respective last blob in the subset of last blobs is expected to belong to a respective trace. In particular, the subset of last blobs does not form one common trace.

In some embodiments, the video management system can receive, by the rendering subsystem, the subset of last blobs from the transmitter. The video management system generates, by the rendering subsystem, one or more tracking traces based on the subset of last blobs by applying a tracking trace generation procedure. The video management system provides, by the rendering subsystem, at least one of said one or more tracking traces for rendering by the output unit.

According to a further aspect, the object is achieved by a video management system or the capturing subsystem configured for providing blobs. The video management system can comprise a capturing subsystem, which comprises a tracking sensor. The video management system or the capturing subsystem is configured for capturing, by the tracking sensor, a tracking stream, which comprises tracking image frames. The video management system or the capturing subsystem is configured for, for each tracking image frame, according to the following. The video management system or the capturing subsystem is configured for detecting, by the capturing subsystem, a set of last blobs for said each tracking image frame by applying a blob detection procedure to said each tracking image frame and one or more further tracking image frames of the tracking stream. Said each tracking image frame is subsequent to said one or more further tracking image frames. The video management system or the capturing subsystem is configured for assigning, by the capturing subsystem and for each last blob of the set of last blobs, said each last blob to one or more traces, thereby obtaining a set of traces after assignment of all of the last blobs of the set of last blobs, wherein the set of traces comprises said one or more traces assigned to said each last blob.

Furthermore, the video management system or the capturing subsystem is configured for generating, by the capturing subsystem, a respective score for each trace of the set of traces based on one or more of:

- a start location of said each trace,
- an initial straightness of said each trace,
- an acceleration of said each trace,
- a direction of said each trace,
- a gradually decreasing size of blobs assigned to said each trace,
- a length of said each trace,
- a blob count of said each trace, or the like, or
- a combination thereof.

The video management system or the capturing subsystem is configured for selecting, by the capturing subsystem, a subset of selected traces from the set of traces. Each selected trace of the subset of selected traces has the respective score that is among most extreme scores of the set of scores.

The video management system or the capturing subsystem is configured for obtaining, by the capturing subsystem, a subset of last blobs based on the subset of selected traces.

In some embodiments, the video management system or the capturing subsystem is configured for sending, by the transmitter, the subset of selected last blobs to the rendering subsystem that is configured to use the subset of selected last blobs for rendering one or more tracking traces to be presented on the output unit 129. The video management system is configured for receiving, by the rendering subsystem, the subset of last blobs from the transmitter.

In some embodiments, the video management system is configured for generating, by the rendering subsystem, one or more tracking traces based on the subset of last blobs by applying a tracking trace generation procedure. The video management system is configured for providing, by the rendering subsystem, at least one of said one or more tracking traces for rendering by the output unit.

According to the embodiments herein, the respective score for each trace of the set of traces can be generated based on one of:

a start location of said each trace,
an initial straightness of said each trace,
an acceleration of said each trace,
a direction of said each trace,
a gradually decreasing size of blobs assigned to said each trace,
a length of said each trace,
a blob count of said each trace, or the like, or
a combination of two or more of the above.

According to a still further aspect, there is provided a method, e.g. performed by a video management system, for managing blobs and/or optionally a calibration frame. The video management system comprises a capturing subsystem, which comprises a tracking sensor a transmitter, and a video camera. The video management system comprises a rendering subsystem comprising an output unit.

The video management system captures, by the tracking sensor, a tracking stream, which comprises tracking image frames.

The video management system performs one or more of the following actions for each tracking image frame. The video management system detects, by the capturing subsystem, a set of blobs for said each tracking image frame by applying a blob detection procedure to said each tracking image frame and one or more further tracking image frames of the tracking stream. The set of blobs can be referred to as "set of last blobs" when this embodiment is combined with the embodiment including e.g. generation of scores as described above. Said each tracking image frame is subsequent to said one or more further tracking image frames. The video management system can compress, by the capturing subsystem, at least one of the tracking image frames into a calibration frame. The video management system transforms, by the capturing subsystem, the set of blobs and/or optionally the calibration frame into a binary signal for carrying audio data. The video management system captures, by the video camera, a video stream, comprising video frames. The video management system embeds, by the capturing subsystem, the binary signal in an audio channel of the video stream. The video management system sends, by the transmitter, the video stream to the rendering subsystem. The video management system receives, by the rendering subsystem, the video stream from the capturing subsystem. The video management system extracts, by the rendering subsystem, the embedded set of blobs and/or optionally the calibration frame from the audio channel of the video stream. The video management system generates, by the rendering subsystem, said one or more tracking traces based on the set of blobs by applying a tracking trace generation procedure. The video management system can calibrate, by the rendering subsystem, coordinate systems of the video camera and the tracking sensor based on at least the calibration frame and a video frame related to the calibration frame to obtain a coordinate transformation.

The video management system can transform, by the rendering subsystem, the tracking trace to the coordinate system of the video camera using the coordinate transformation. The video management system renders, by the rendering subsystem, at least a portion of the transformed tracking trace in the video frames. The rending subsystem 120 can send the rendered video frames to the output unit.

In this manner, the video management system takes advantage of the audio channel of the video stream in order to transmit the set of blobs and optionally the calibration frame.

In some embodiments, the method comprises receiving, by the rendering subsystem, the set of blobs from the transmitter comprised in the video stream, and providing, by the rendering subsystem, at least one of said one or more tracking traces for rendering by the output unit.

BRIEF DESCRIPTION OF THE DRAWINGS

The various aspects of embodiments disclosed herein, including particular features and advantages thereof, will be readily understood from the following detailed description and the accompanying drawings, which are briefly described in the following.

DETAILED DESCRIPTION

Figure 1A:
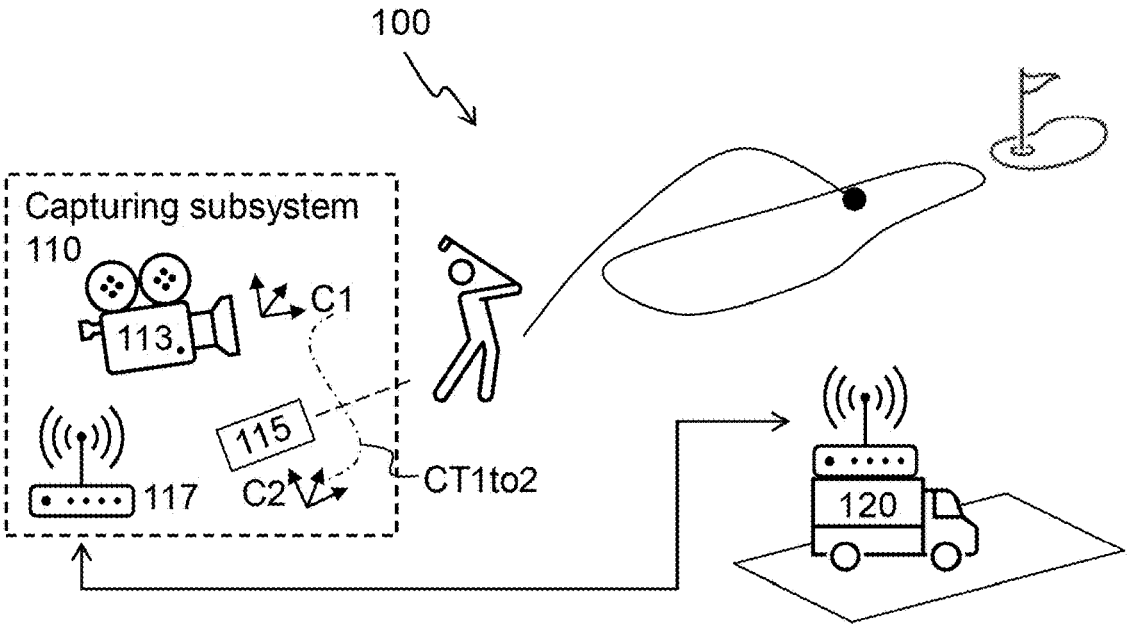
FIG. 1*a* and FIG. 1*b* are schematic overviews of an example of a system in which embodiments herein may be implemented.

Throughout the following description, similar reference numerals have been used to denote similar features, such as nodes, actions, modules, circuits, parts, items, elements, units or the like, when applicable. In the Figures, features that appear in some embodiments may be indicated by dashed lines, but not necessarily.

FIG. 1*a* shows an exemplifying system 100 according to the embodiments herein. The system is configured to track a golf ball in flight and to provide a video stream including a trace of the golf ball's trajectory in the air.

The system 100 includes a capturing subsystem 110 and a rendering subsystem 120.

The capturing subsystem 110 can be configured to capture at least tracking data, from which a trace of the golf ball can be derived. The capturing subsystem 110 may further be configured to capture a video, whose video frames may be provided, e.g. rendered in or on, with at least a portion of the trace.

Furthermore, the capturing subsystem 110 can include a camera 113, such as a broadcast camera, a video camera, a camcorder, a video capturing device, or the like. The camera 113 may be configured to provide a video stream processable by the capturing subsystem 110. The capturing subsystem 110 further comprises a tracking sensor 115. The tracking sensor 115 is configured to provide tracking data, such as tracking image frames, tracking frames, tracking data maps, radar tracking signals, lidar tracking signals, or the like, to the capturing subsystem 110. In more detail, the tracking sensor 115 may comprise one or more of a radar, a lidar, a video capturing device, a camera, a videorecorder, a high-speed camera, a high-speed video recording device, a combination thereof, or the like. In this context, it may be noted that high-speed refers to an image capturing rate, often measured in frames per second (fps), of 500 fps, 1000 fps, 10 000 fps, 100 000 fps or more.

Notably, a lidar can typically provide tracking data in the form of distance data, e.g. distance measurements to objects, intensity data, e.g. reflectivity or intensity of a returned laser pulse, and/or point cloud data, e.g. three-dimensional coordinates (X, Y, Z) of points in the environment, where each point of the point cloud can reflect intensity, etc., Furthermore, a radar can typically provide tracking data in the form of range data, e.g. distance to objects, velocity, e.g. radial velocity of objects (Doppler shift), which can be used to determine the speed and direction of moving objects, and/or reflectivity data, e.g. strength of the returned radar signal, which can be used to infer some properties, such as absorption, or the like, of the detected objects.

Additionally, the capturing system 110 may comprise a transmitter 117, such as a radio frequency transmitting device, an RF-transmitter, an RF-transceiver, or the like. The transmitter 117 may be configured for wireless communication, i.e. radio frequency communication, with the rendering subsystem 120, viz. the transmitter 117 may comprise a wireless transmitter configured for wireless transfer of data to a wireless receiver.

The rendering subsystem 120 may comprise a receiver 127, such as a radio frequency receiving device, an RF-receiver, an RF-transceiver, or the like. The receiver 127 may be configured for wireless communication, i.e. radio frequency communication, with the capturing subsystem 110, viz. the receiver 127 may comprise a wireless receiver configured for wireless reception of data from a wireless transmitter, an RF-receiver or a fiber-optic receiver.

The rendering subsystem 120 may further comprise an output unit 129, such a sending unit, a storage unit, a connection interface for broadcasting of a video stream, a display device, a screen, or the like.

In various more detailed examples, the tracking sensor 115, aka tracking camera, may be mounted on top of the camera 113, aka broadcast camera, along with an optional radar. A raw image stream is sent from the tracking sensor 115 to a single board computer, e.g. of the capturing subsystem 110, that may be mounted in the camera housing of the camera 113, in the casing of the tracking sensor 115, or as an entity separated therefrom. Based on the brightness in the image, the exposure time of the camera 113 is automatically adjusted. Other parameters such as shutter speed and framerate are also controlled, e.g. by a camera control software.

Figure 1B:
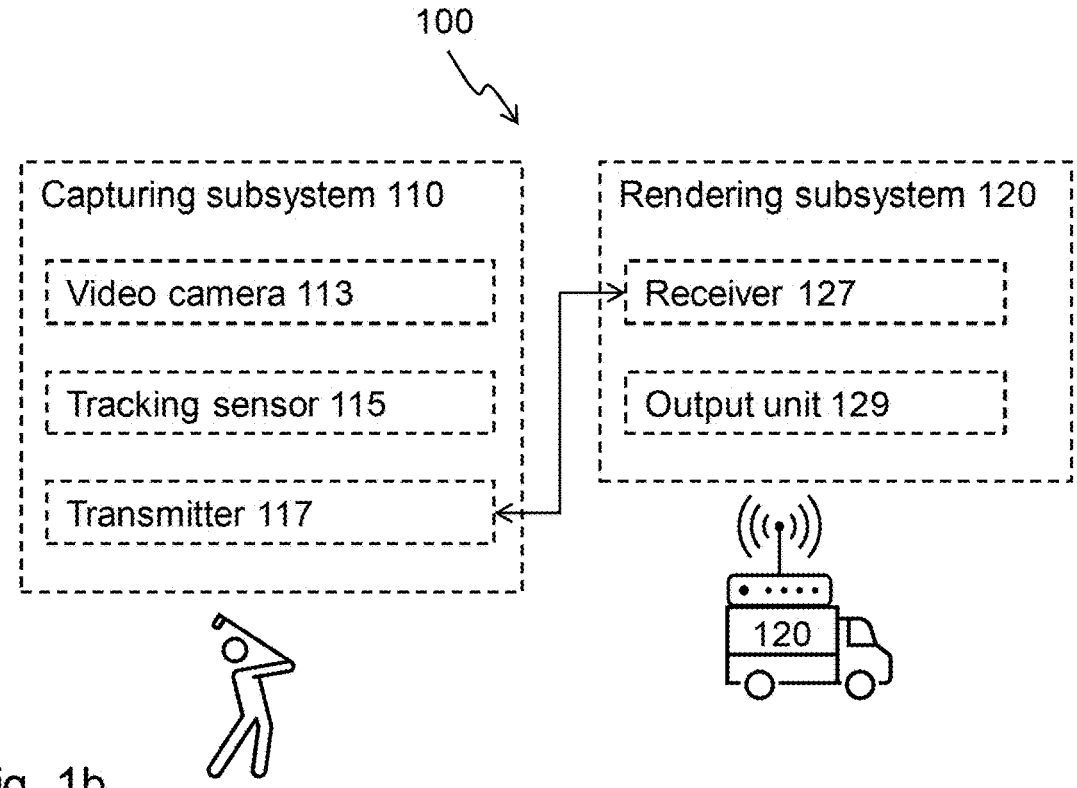

FIG. 1*b* is a block diagram of the exemplifying video management system 100 of FIG. 1*b*. As mentioned, the capturing subsystem 110 may comprise the video camera 113, the tracking sensor 115 and the transmitter 117 and the rendering subsystem 120 may comprises the receiver 127 and the output unit 129.

As used herein, a blob can refer to a bundle of tracking data that have been identified as being a moving bundle of tracking data from one tracking data map, e.g. of a first timestamp, to another tracking data map, e.g. of a second timestamp. The bundle of tracking data is thus a sub-set of data points identified in the first and second tracking data maps. The first and second timestamps are typically subsequent in a time series of tracking data maps of the tracking stream. The tracking data can be obtained, such as received, fetched, or the like, from a tracking sensor, such as a radar, a lidar, a camera, a video camera, a high-speed still image camera, or the like. As an example, a blob comprises a set of pixels, i.e. one or more pixels, that have been identified as being a moving collection of pixels from one frame to another subsequent frame, e.g. by use of a blob detection procedure. In related literature, e.g. Computer Vision (CV), many known blob detection procedures are described. For example, differential blob detection, spatial blob detection, grey-level blob detection or the like. For the purpose of at least some embodiments herein, any known blob detection procedure that is appropriate for supporting tracking of moving objects may be applied to the tracking image frame of the tracking stream. Other suitable blob detection procedures may also be used. As another example, the blob can comprise a radar and/or lidar data set that has been identified as being a moving data set from one tracking data map to another tracking data map. In some examples, the blob can comprise a set of radar and/or lidar measurements, e.g. movement measurements or the like.

As used herein, a trace comprises a series of blobs detected in subsequent frames, where the series of blobs is determined to pertain to the same moving object, such as sports projectile or the like. A known or proprietary tracing procedure may be used for this purpose. Again, in related literature many known tracing procedures are described. Blob detection and/or tracking procedure are known from e.g. U.S. Pat. Nos. 11,335,013, 10,338,209 and other documents.

As used herein, the terms "golf ball", "tracked object", "sports projectile" or the like, may have been used interchangeably. A tracked object may thus be a sports projectile, a golf ball, a ball, a tennis ball, a boule ball, a football, a soccer ball, a badminton ball, a curling stone or the like.

Figure 2A:
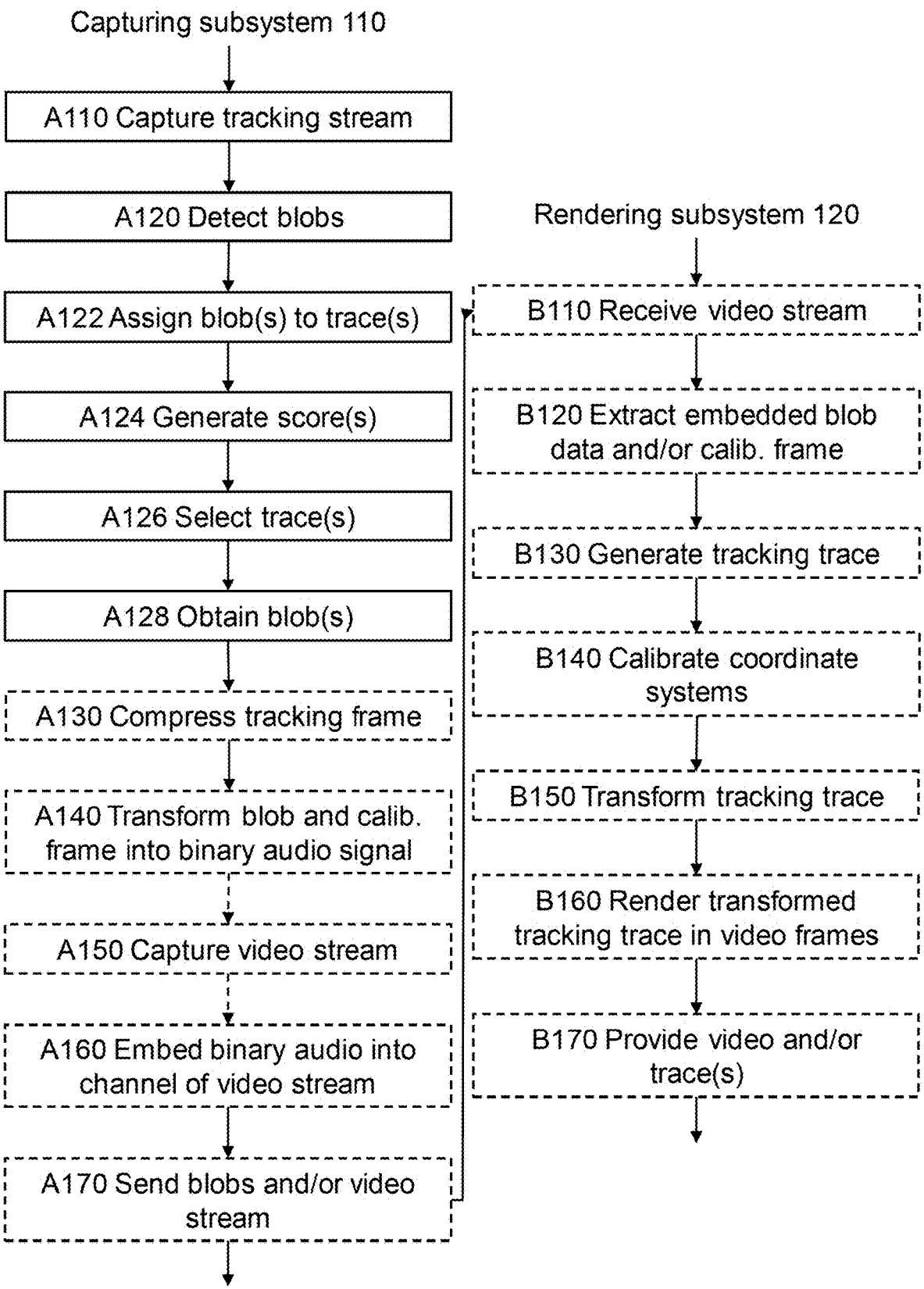
FIG. 2*a* is a combined signaling and flowchart illustrating embodiments of the methods herein, e.g. performed by the video management system.
Figure 2B:
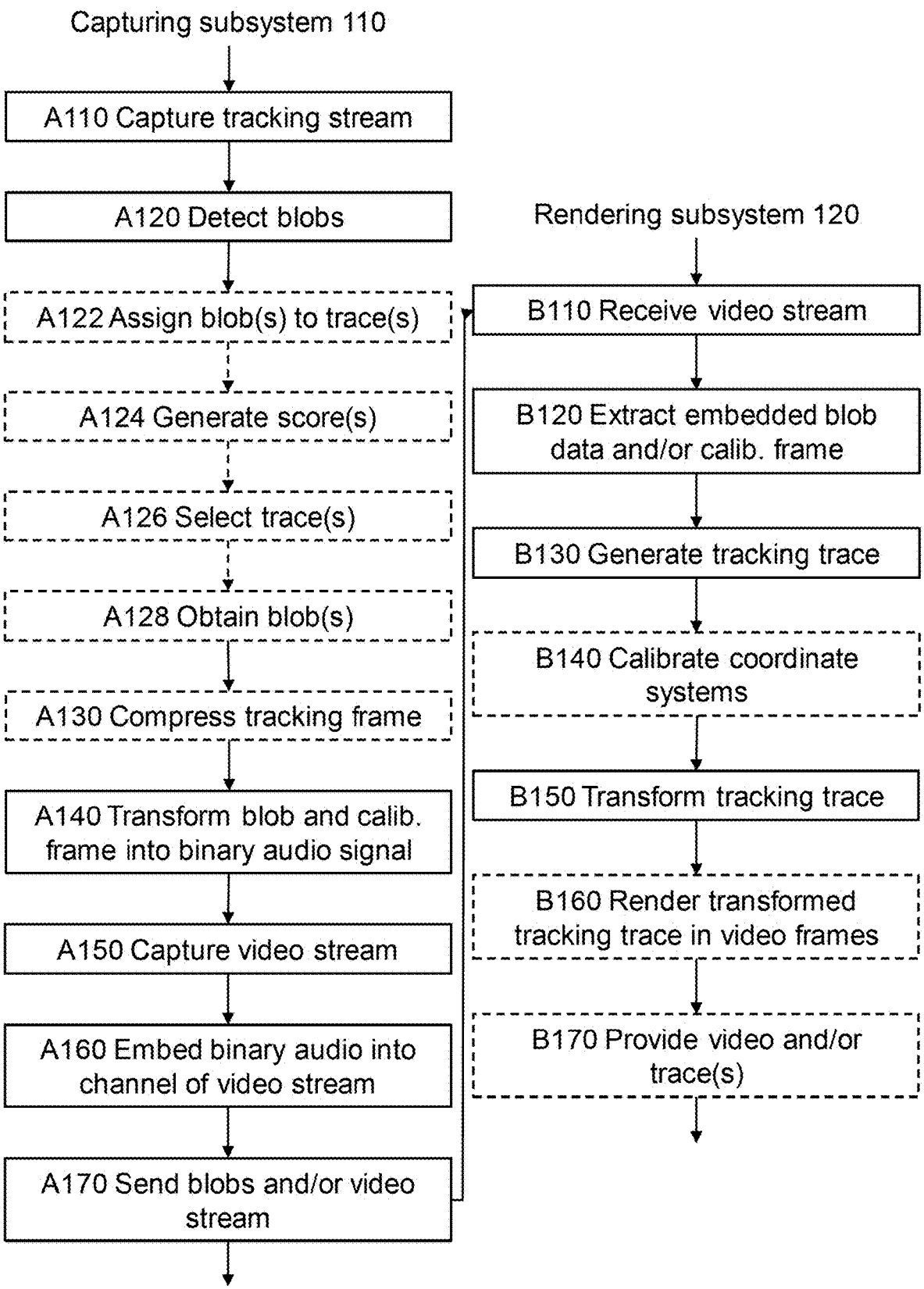
FIG. 2*b* a further combined signaling and flowchart illustrating embodiments of the method herein, e.g. performed by the video management system.

In the following FIG. 2*a* and FIG. 2*b*, two sets of examples are described. FIG. 2*a* describes examples of a blob filtering method that can be combined with examples of a use of an audio channel of a video stream carried on an RF link for transfer of blob data and optionally a calibration data map, such as a calibration frame, or the like. FIG. 2*b* describes that the examples of the use of the audio channel of the video stream carried on the RF link for transfer of the blob data and optionally the calibration frame can be combined with the examples of the blob filtering method.

FIG. 2*a* shows an exemplifying method for providing blobs, e.g. a blob filtering method. As an example, the video management system 100 performs a method for managing, e.g. a provision or generation of a set of blobs, such as last blobs. As mentioned, the video management system 100 comprises the capturing subsystem 110 and optionally the rendering subsystem 120. The capturing subsystem 110 may perform a method for compressing blob data, e.g. by filtering blob data based on knowledge about expected trace behavior of a sports projectile, such as a golf ball, or the like. Blob data may refer to a set of blobs, or the like. In some examples, the video management system 100 may perform a method for managing a video stream.

The method(s) herein may generally be so called computer-implemented method(s).

One or more of the following actions may be performed in any suitable order.

Action A110

The video management system 100 captures, e.g. using the capturing subsystem 110, and for example by means of the tracking sensor 115, a tracking stream. The tracking stream comprises tracking data maps, e.g. representing output from the tracking sensor 115. The tracking stream represents a series of time stamps, where each time stamp is associated with a respective tracking data map. The tracking data maps can be tracking data, tracking image frames, radar data sets, lidar data set, or the like. The tracking stream can comprise 2D or 3D representations of the field of view of the tracking sensor 114, such as tracking data, tracking data maps, tracking image frames. The tracking sensor 115 may comprise a video recording device and optionally a radar device (not shown). The video recording device and/or the radar device may be configured to capture the tracking stream.

The method further comprises, e.g. for each tracking image frame, one or more of actions A120-B170 according to various examples:

Action A120

The video management system 100 detects, by the capturing subsystem 110, a set of last blobs for said each tracking image frame by applying a blob detection procedure to said each tracking image frame and, i.e. in addition to said each tracking image frame, one or more further tracking image frames of the tracking stream. Said each tracking image frame is subsequent to said one or more further tracking image frames. The set of last blobs can comprise at least two last blobs.

In some examples, the blob detection procedure may include a filtering operation for filtering out blobs that should not be considered in the further processing herein. Such filtering may be based on e.g. a size of the blob, a position of the blob or the like. The filtering may be considered to be a part of the blob detection. Alternatively or additionally, it may be considered to be an intermediate operation between the blob detection procedure and the below mentioned tracing procedure. However, should it be that the filtering would be considered to be part of the tracing procedure, it would imply that only some of the last blobs of the set of last blobs would be assigned to a respective trace as described in action A122 below.

Action A122

For each last blob of the set of last blobs, the video management system 100 assigns, by the capturing subsystem 110, said each last blob to one or more traces, thereby obtaining a set of traces after assignment of all of the last blobs of the set of last blobs. The set of traces comprises said one or more traces assigned to said each last blob. In some examples, the set of traces can comprise at least two traces. It shall hence be understood that one particular blob may be assigned to one or more traces. Furthermore, this may mean that two different blobs may be assigned to one and the same trace.

This means that the video management system 100, such as the capturing subsystem 110, maintains, such as keeps track of, monitors, or the like, a set of maintained traces, e.g. by use of a tracing procedure. The maintained trace may be referred to as monitored traces, kept traces or the like. For the purpose of at least some embodiments herein, any known or proprietary tracing procedure that is appropriate for tracking of moving objects may be applied to the set of last blobs.

As an example, it may be noted that a blob that has not been assigned to a corresponding maintained trace, will form a new maintained trace comprising only one blob.

As a result of action A122, the set of traces, e.g. the set of maintained traces, will be obtained, such as generated, formed or the like.

Action A124

In order to filter out at least some of the set of traces, the video management system 100 generates, by the capturing subsystem 110, a respective score for each trace of the set of traces based on one or more of:

- a start location of said each trace, such as a start location sub-score or the like,
- an initial straightness of said each trace, such as an initial straightness sub-score or the like,
- an acceleration of said each trace, such as an acceleration sub-score or the like,
- a direction of said each trace, such as a direction sub-score or the like,
- a gradually decreasing size of blobs assigned to said each trace, such as a gradually decreasing size sub-score or the like,
- a length of said each trace, such as a length sub-score or the like,
- a blob count of said each trace, such as a blob count sub-score or the like, or the like, or
- a combination thereof.

A set of scores comprises the respective score for said each trace.

Furthermore, expressed differently, the video management system 100 generates, e.g. by the capturing subsystem 110, the respective score for each trace of the set of traces based on one or more of:

- the start location of said each trace,
- the initial straightness of said each trace,
- the acceleration of said each trace,
- the direction of said each trace,
- the gradually decreasing size of blobs assigned to said each trace,
- the length of said each trace,
- the blob count of said each trace, and
- the like.

As an example, this means that the respective score may be generated for each maintained trace. In the following paragraphs each of the aforementioned sub-scores are explained in more detail.

The start location of said each trace may be generated based on a position in the tracking image frame of the first blob in said each trace. As an example, the start location, or start location sub-score, reflects how low in the tracking image frame the first blob in a trace is located. The first blob refers to the blob that is first among the blobs forming the trace, e.g. blob with index zero in case of an array, having a length, with indexing from zero to the length reduced by one. The start location is awarded a low score, if the trace starts high in the tracking image frame, and a high score if the trace starts low in the tracking image frame. For example, along a vertical line of the tracking image frame having a start at the lower edge and an end at the higher edge, the start location sub-score may be normalized between 1 and −1, where 1 corresponds to a start location at the lower edge of the tracking image frame and −1 corresponds to a start location at the higher edge of the tracking image frame. However, the start location may be normalized or non-normalized according to various embodiments.

The initial straightness of said each trace may be generated based on a comparison between an aggregated stepwise distance for a sequence of blobs of said each trace and a linear distance between the first and the last blob of said each trace. As an example, the initial straightness reflects whether the start of the trace is straight by comparing the distance between groups of blobs, such as groups of three blobs, four blobs, five blobs etc. For each group the direct, and e.g. straight, distance between the first and the last blob, such as the third blob, is compared to an aggregated distance determined as the sum of the distance between the first and second blobs and the distance between the second and third blobs. If the stepwise aggregated distance is the same or only slightly larger than the direct distance a high score is awarded to the initial straightness, whereas an even larger distance awards a lower score to the initial straightness. As an example, the score may be normalized towards a range from the direct distance to the direct distance increased by a percentage, such as 10%, 15% or the like, where e.g. 1 may be awarded when the stepwise aggregated distance is the same as the direct distance and −1 may be awarded when the stepwise aggregated distance is equal to or greater than the direct distance increased by said percentage. This is repeated for a number of groups of blobs in the start of the trace and the total initial straightness sub-score is determined as the average sub-score taken among the number of groups. The groups may or may not be overlapping. The number of groups may be 2, 3, 4, 5 or the like. A numerical example is provided for the convenience of the reader: ((0 1 2), (1 2 3), (2, 3, 4)). This example shows three groups in the beginning of the trace, where each group comprises three blobs identified by their index.

The acceleration of said each trace may be generated based a comparison of stepwise distances between a sequence of blobs. The acceleration is awarded a high score if the trace is slowing down, that is if the distance between a first and a second blob is greater than the distance between the second and a third blob. The acceleration is awarded a low score if the trace is speeding up. Similarly to the initial straightness sub-score above, groups of blobs may be assessed and then an average score may be calculated. As above, there may be groups of three blobs, four blobs, five blobs etc. Also as above, the number of groups may be 2, 3, 4, 5 or the like. As an example, for each set of three blobs a high score is achieved if the trace is slowing down, that is if the distance between the first and the second blob is larger than the distance between the second and third. If the trace is speeding up, a low score is awarded instead.

The direction of said each trace may be generated based on 1) for blobs before apex of said trace, that each blob has an adjacently following blob that is above said each blob, and based on 2) for blobs after apex of said trace, that each blob has an adjacently following blob that is below said each blob. The apex is detected by identification of a predetermined number of adjacent blobs, in which each blob is below any existing adjacently preceding blob within the predetermined number of adjacent blobs. As an example, the direction reflects whether the sports projectile, such as the golf ball, initially rises continuously and then, e.g. after an apex, such as a climax, highest position or the like, continuously falls downwards until it hits the ground. Bouncing may occur after the ground has been hit depending on visibility and/or whether fairway, bunker or ruff is at the landing position. As an example, the direction sub-score calculation may be split into two parts, i.e. a first part and a second part. In the first part, i.e. before apex, each blob that is below the blob after it contributes to a high score and each blob that is above the blob after it contributes to a low score. In the second part, i.e. after apex, the scoring is reversed with high score for falling blobs and low scores for rising blobs.

The gradually decreasing size of the set of blobs assigned to said each trace may be generated based on that a respective size of each blob decreases, or generally decreases, towards an end of said each trace. The gradually decreasing size may reflect that the traced sports projectile, such as the golf ball, is moving away from the tracking sensor. As an example, this sub-score is awarded a high score when blobs at the start of the trace become smaller and smaller in size the further along the trace you get. If the blobs instead get bigger and bigger a low score is awarded.

The length of said each trace may be generated based on a summation of distances between the blobs of said each trace. The length sub-score reflects a total distance in the image from the beginning to the currently last blob of the trace. As an example, the length sub-score is awarded a high score if the total distance in an image frame that the trace covers is long and a low score if the distance is short.

The blob count of said each trace may be generated based on a count of the blobs forming said each trace. The blob count may reflect how many blobs the trace is built up by. As an example, the blob count sub-score is awarded a high score for traces with many blobs in them, i.e. traces that have been going, such as monitored, on for a long time, and a low score to traces with few blobs. Again, the blob count may or may not be normalized, e.g. among the set of monitored traces.

In the examples above, traces with high scores will be more likely to contribute with a blob that will be kept, or filtered in, and next e.g. sent in action A170. However, in other examples, the scoring may be different, e.g. such that traces with low scores will be more likely to contribute with a blob that will be kept, and next e.g. sent in action A170.

Notably, other sub-scores may be applied in addition to those mentioned above without departing from the scope as defined by the appended independent claims.

Action A126

The video management system 100 selects, e.g. by the capturing subsystem 110, a subset of selected traces from among the set of traces. Each selected trace of the subset of selected traces has the respective score that is among most extreme scores, such as maximum scores, minimum scores or the like, of the set of scores.

In some examples, the most extreme scores can be any score that satisfies, e.g. is greater than, is less than or the like, a threshold value. The threshold value can be absolute or relative, e.g. as a percentage of the most extreme score, or the like. A relative threshold can be set based on a standard deviation for a distribution depicting the set of scores, e.g. n multiplied by the standard deviation, where n can be 1, 2, 3, 4 . . . , etc. by choice for the specific case.

Generally, the highest or lowest score can be selected depending on implementation details, e.g. whether "high" or "low" is associated with scores that are probable to relate to an actual ball. Summarizing, among the most extreme scores can refer to a maximum score, a minimum score, scores that satisfies a threshold as explained above, a top number of scores, e.g. the top three scores, the top four scores etc., a bottom number of scores, e.g. the bottom/least three scores, the bottom/least four scores etc., The subset of selected traces may include less than a particular number of traces. The particular number may be predetermined or dynamically determined based on e.g. bandwidth available between the capturing subsystem 110 and the rendering subsystem 120. The particular number may be less than 50, 30, 20, 10, 5, or the like.

Action A128

The video management system 100 obtains, by the capturing subsystem 110, a subset of last blobs based on the subset of selected traces. In this manner, the video management system 100 e.g. selects the subset of blobs from among the set of blobs. E.g. each selected blob of the subset of selected blobs is the aforementioned each last blob that was assigned to a respective selected trace of the subset of selected traces in action A122.

As an example, this may mean that the subset of last blobs comprises each respective last blob of the subset of selected traces. Clearly, the set of last blobs comprises the subset of last blobs.

In view of the above, as an example, for each tracking image frame a new set of blobs is received and assigned to one or more traces if possible. If a blob does not belong to any trace, a new trace is created with that blob as the first blob. The score for each updated, or newly created, trace is calculated and the latest blobs from the best X traces are selected to be kept. These latest blobs can be sent to the rendering subsystem 120 later on. The best X traces may be those with the highest or lowest respective score depending on chosen scoring, i.e. whether high implies keep or discard etc. X may be a fixed number, such as 3, 4, 5 etc. or a dynamic number according to e.g. available bandwidth. In this manner, the capturing subsystem 110 filters out blobs that are not probable to pertain to a tracked golf ball. Expressed differently, the capturing subsystem 110 filters in blobs that are likely to belong to a tracked golf ball.

In some examples, the video management system 100 also provide, by the capturing subsystem 110, the subset of last blobs already in this action. As an example, the video management system 100 may thus send the subset of last blobs to the rendering subsystem 120, e.g. similarly to as in action A170.

Action A130

Occasionally, for at least some of said each tracking image frames, the video management system 100 may compress, by the capturing subsystem 110, at least one of the tracking image frames into a calibration frame. In these examples, a tracking data map can typically be a tracking image frame. However, it is contemplated that also the tracking data maps, e.g. when including radar/lidar detection data, can be used for calibration purposes. For example, a distinct feature can be identified in the tracking data map and then the same distinct feature can be identified in video frames captured by the capturing subsystem 110, such as the video camera 113, or the like, the calibration data map can be used for calibration. The capturing subsystem 110 may use a lossless or lossy compression algorithm for the purpose of compressing said at least one of the tracking image frames into the calibration frame. The calibration frame may be used by the rendering subsystem 120 to determine a coordinate transformation between a broadcast coordinate system of the video camera 113 and a tracking coordinate system of the tracking sensor 115.

The compressing A130 of said at least one of the tracking image frames into the calibration frame may be triggered every nth second, such as every 10 ms, every 100 ms, every 500 ms or the like.

The calibration frame has a compression ratio that maintains a resolution of the calibration frame above a threshold value such that calibration is achievable, e.g. by the rendering subsystem 120. The compression ratio can be at least two, at least four, at least five, or at least ten, or the like. Generally, the compression ratio may be calculated as an original image size divided by a compressed image size.

Action A140 The video management system 100 may transform, by the capturing subsystem 110, the subset of selected blobs and/or the calibration frame into a binary signal. As an example, the transformation of the subset of selected blobs and/or the calibration frame into the binary signal may be performed regularly, e.g. at a predetermined frequency, or irregularly. The predetermined frequency may be 25, 29.97, 50 Hz or the like, such as for each frame of the tracking stream, for each set of traces, for each subset of selected traces, for each video frame captured in action A150 or the like. Sometimes, the calibration frame is not transformed into a binary signal in order for available bandwidth to be used for transfer of the subset of selected blobs. The binary signal can have two levels, "0" and "1", where data of the subset of selected blobs is modulated onto a carrier wave. As an example, 8 000 Hz may represent "0" and 16 000 Hz may represent "1" or vice versa. In this example, a bit rate of 8 kbits/s may thus be obtained, since at least one period of the lowest of the two frequencies above will be required for one bit to be represented. The binary signal may thus carry information about the subset of selected blobs in the form of a binary audio signal. Each blob may comprise image data and optionally radar data as the case may be. It shall be noted that the filtering of blobs implies that less data is required. Accordingly, less bandwidth would be required for a transfer, such as in action A170.

Action A150

In some embodiments, the video management system 100 may capture, by the video camera 113, a video stream, comprising video frames. Expressed differently, the video camera 113 of the video management system 100 may capture the video stream. In more detail, the video frames may comprise image frames. The video stream may comprise one or more audio streams, or audio channels, according to known manners.

Action A160

The video management system 100 may embed, by the capturing subsystem 110, the binary signal in an audio channel of the video stream. As an example, this may mean that the audio channel of the video stream is populated with the data of the subset of select blobs and/or the calibration frame.

Action A170

The video management system 100 sends, by the transmitter 117, the subset of selected last blobs to the rendering subsystem 120 that is configured to use the subset of selected last blobs for rendering one or more tracking traces to be presented on the output unit 129, i.e. multiple subsets of selected last blobs from different tracking image frames will be required to build said one or more tracking traces. This means e.g. that for each tracking image frame the subset of last blobs are transmitted, where the last blobs in the subset can belong to different traces. In particular, this means that the subset of last blobs does not build up a specific trace.

In some embodiments, the video management system 100 may send, by the transmitter 117, the video stream. The video stream may include the subset of last blobs, and optionally the calibration frame, of the binary signal included in the video stream, to the rendering subsystem 120.

Notably, the subset of selected blobs and/or the calibration frame may be transmitted, e.g. by the capturing subsystem 110, using any desired channel. The channel can have a very limited bandwidth, but of course if the channel has a broader bandwidth than required, the channel simply allows for transfer of any other further data should it be needed. The channel may be a data channel, an audio channel, a video channel or the like. The channel may be carried on any suitable medium, such as using radio waves, wifi, cellular network, or the like.

In some examples, this action may follow after action A128.

Action B110

Subsequent to action A170, the video management system 100 receives, e.g. by the rendering subsystem 120, the subset of last blobs from the transmitter 117.

In some embodiments, the video management system 100 may receive, by the rendering subsystem 120, the video stream from the capturing subsystem 110. In more detail, the subset of last blobs and/or the video stream may be received by the receiver 127 of the rendering subsystem 120.

Action B120

The video management system 100 may extract, by the rendering subsystem 120, the embedded subset of selected blobs and/or the calibration frame from the audio channel of the video stream. The rendering subsystem 120 may decode the subset of last blobs of the audio channel, e.g. by doing the inverse, or opposite, procedure as compared to what was performed by the capturing subsystem 110 in e.g. action A140. As an example, the capturing subsystem 110 and the rendering subsystem 120 uses an encoder and a decoder of the same coding scheme.

Action B130

The video management system 100 generates, by the rendering subsystem 120, a tracking trace based on the subset of last blobs by applying a tracking trace generation procedure that selects one trace that is most probably corresponds to an actual trajectory of the tracked sports projectile. Again, the tracking trace generation procedure may be using one or more known techniques for tracking traces, e.g. alone or in combination with each other.

Action B140

The video management system 100 may calibrate, by the rendering subsystem 120, coordinate systems C1, C2 of the video camera 113 and the tracking sensor 115 based on at least the calibration frame 210 and a video frame related to the calibration frame 210 to obtain a coordinate transformation CT1 to 2. The calibration between the coordinate system C1, C2 of the video camera 113 and the tracking sensor 115 may also be performed according to known procedures, e.g. using measurements in combination with trigonometric calculations.

Action B150

In order for the tracking trace to be rendered correctly in the video frames of the video stream, the video management system 100 may transform, by the rendering subsystem 120, the tracking trace to the coordinate system C1 of the video camera 113 using the coordinate transformation obtained in action B140.

Action B160

The video management system 100 may render, by the rendering subsystem 120, at least a portion of the transformed tracking trace in the video frames.

Action B170

The video management system 100 provides, by the rendering subsystem 120, at least one of said one or more tracking traces for rendering by the output unit 129. The providing in action B170, e.g. the provision in the present action, may comprise sending the rendered video frames to the output unit 129. In this manner, a viewer of the rendered video frames may get an enhanced experience thanks to the tracking trace rendered in the video frames.

With at least some embodiments herein, an advantage may be that requirements, e.g. in terms of bandwidth, for transfer of blobs from the capturing subsystem 110 to the rendering subsystem 120 may be more relaxed, e.g. less bandwidth may be required. Generally, an advantage is that the amount of blob data is reduced, which thus consumes less memory, enables faster processing since less data has to be processed and the like.

FIG. 2*b* shows exemplifying methods for managing a video stream, such as managing blobs and optionally a calibration frame. As an example, the video management system 100 performs a method for managing, e.g. a provision of a set of blobs, such as last blobs. As mentioned, the video management system 100 comprises the capturing subsystem 110 and optionally the rendering subsystem 120. The capturing subsystem may perform a method for compressing blob data, e.g. by sending blob data in an audio channel of a video stream carried on an RF link. The RF link provides a communication link between the capturing subsystem 110 and the rendering subsystem 120. Blob data may refer to a set of blobs, or the like. In some examples, the video management system 100 may perform a method for managing a video stream. The method(s) herein may generally be so called computer-implemented method(s).

One or more of the following actions may be performed in any suitable order.

Action A110

The video management system 100 captures, e.g. using the capturing subsystem 110, and for example by means of the tracking sensor 115, a tracking stream. The tracking stream can comprise 2D representations of the field of view of the tracking sensor 114, such as tracking image frames. The tracking sensor 115 may comprise a video recording device and optionally a radar device (not shown). The video recording device and/or the radar device may be configured to capture the tracking stream.

The method further comprises, e.g. for each tracking image frame, one or more of actions A120-B170 according to various examples:

Action A120

The video management system 100 detects, by the capturing subsystem 110, a set of blobs for said each tracking image frame by applying a blob detection procedure to said each tracking image frame and, i.e. in addition to said each tracking image frame, one or more further tracking image frames of the tracking stream. Said each tracking image frame is subsequent to said one or more further tracking image frames. The set of blobs can comprise at least two blobs. When this example is combined with the use of the audio channel, the set of blobs can be referred to as the set of last blobs. Accordingly, as used throughout the present disclosure, the set of blobs can refer to the set of last blobs, or vice versa, when applicable.

In some examples, the blob managing procedure may include a filtering operation for filtering out blobs that should not be considered in the further processing herein. Such filtering may be based on e.g. a size of the blob, a position of the blob or the like. The filtering may be considered to be a part of the blob detection. Alternatively or additionally, it may be considered to be an intermediate operation between the blob detection procedure and the below mentioned tracing procedure. However, should it be that the filtering would be considered to be part of the tracing procedure, it would imply that only some of the last blobs of the set of last blobs would be assigned to a respective trace as described in action A122 below.

Action A122

In some embodiments, the video management system 100 assigns, by the capturing subsystem 110 and for each last blob of the set of last blobs, said each last blob to one or more traces, thereby obtaining a set of traces after assignment of all of the last blobs of the set of last blobs. The set of traces comprises said one or more traces assigned to said each last blob. In some examples, the set of traces can comprise at least two traces. It shall hence be understood that one particular blob may be assigned to one or more traces. Furthermore, this may mean that two different blobs may be assigned to one and the same trace.

In these embodiments, this means that the video management system 100, such as the capturing subsystem 110, maintains, such as keeps track of, monitors, or the like, a set of maintained traces, e.g. by use of a tracing procedure. The maintained trace may be referred to as monitored traces, kept traces or the like. For the purpose of at least some embodiments herein, any known or proprietary tracing procedure that is appropriate for tracking of moving objects may be applied to the set of last blobs.

As an example, it may be noted that a blob that has not been assigned to a corresponding maintained trace, will form a new maintained trace comprising only one blob. As a result of action A122, the set of traces, e.g. the set of maintained traces, will be obtained, such as generated, formed or the like.

Action A124

In order to filter out at least some of the set of traces, the video management system 100 can generate, by the capturing subsystem 110, a respective score for each trace of the set of traces based on one or more of:

- a start location of said each trace, such as a start location sub-score or the like,
- an initial straightness of said each trace, such as an initial straightness sub-score or the like,
- an acceleration of said each trace, such as an acceleration sub-score or the like,
- a direction of said each trace, such as a direction sub-score or the like,
- a gradually decreasing size of blobs assigned to said each trace, such as a gradually decreasing size sub-score or the like,
- a length of said each trace, such as a length sub-score or the like,
- a blob count of said each trace, such as a blob count sub-score or the like, or the like, or
- a combination of two or more thereof.

Furthermore, expressed differently, the video management system 100 can generate, e.g. by the capturing subsystem 110, the respective score for each trace of the set of traces based on one or more of:

- the start location of said each trace,
- the initial straightness of said each trace,
- the acceleration of said each trace,
- the direction of said each trace,
- the gradually decreasing size of blobs assigned to said each trace,
- the length of said each trace,
- the blob count of said each trace, and
- the like.

As an example, this means that the respective score may be generated for each maintained trace. In the following paragraphs each of the aforementioned sub-scores are explained in more detail.

As mentioned, the start location of said each trace may be generated based on a position in the tracking image frame of the first blob in said each trace. As an example, the start location, or start location sub-score, reflects how low in the tracking image frame the first blob in a trace is located. The first blob refers to the blob that is first among the blobs forming the trace, e.g. blob with index zero in case of an array, having a length, with indexing from zero to the length reduced by one. The start location is awarded a low score, if the trace starts high in the tracking image frame, and a high score if the trace starts low in the tracking image frame. For example, along a vertical line of the tracking image frame having a start at the lower edge and an end at the higher edge, the start location sub-score may be normalized between 1 and −1, where 1 corresponds to a start location at the lower edge of the tracking image frame and −1 corresponds to a start location at the higher edge of the tracking image frame. However, the start location may be normalized or non-normalized according to various embodiments.

As mentioned, the initial straightness of said each trace may be generated based on a comparison between an aggregated stepwise distance for a sequence of blobs of said each trace and a linear distance between the first and the last blob of said each trace. As an example, the initial straightness reflects whether the start of the trace is straight by comparing the distance between groups of blobs, such as groups of three blobs, four blobs, five blobs etc. For each group the direct, and e.g. straight, distance between the first and the last blob, such as the third blob, is compared to an aggregated distance determined as the sum of the distance between the first and second blobs and the distance between the second and third blobs. If the stepwise aggregated distance is the same or only slightly larger than the direct distance a high score is awarded to the initial straightness, whereas an even larger distance awards a lower score to the initial straightness. As an example, the score may be normalized towards a range from the direct distance to the direct distance increased by a percentage, such as 10%, 15% or the like, where e.g. 1 may be awarded when the stepwise aggregated distance is the same as the direct distance and −1 may be awarded when the stepwise aggregated distance is equal to or greater than the direct distance increased by said percentage. This is repeated for a number of groups of blobs in the start of the trace and the total initial straightness sub-score is determined as the average sub-score taken among the number of groups. The groups may or may not be overlapping. The number of groups may be 2, 3, 4, 5 or the like. A numerical example is provided for the convenience of the reader: ((0 1 2), (1 2 3), (2, 3, 4)). This example shows three groups in the beginning of the trace, where each group comprises three blobs identified by their index.

As mentioned, the acceleration of said each trace may be generated based a comparison of stepwise distances between a sequence of blobs. The acceleration is awarded a high score if the trace is slowing down, that is if the distance between a first and a second blob is greater than the distance between the second and a third blob. The acceleration is awarded a low score If the trace is speeding up. Similarly to the initial straightness sub-score above, groups of blobs may be assessed and then an average score may be calculated. As above, there may be groups of three blobs, four blobs, five blobs etc. Also as above, the number of groups may be 2, 3, 4, 5 or the like. As an example, for each set of three blobs a high score is achieved if the trace is slowing down, that is if the distance between the first and the second blob is larger than the distance between the second and third. If the trace is speeding up, a low score is awarded instead.

As mentioned, the direction of said each trace may be generated based on 1) for blobs before apex of said trace, that each blob has an adjacently following blob that is above said each blob, and based on 2) for blobs after apex of said trace, that each blob has an adjacently following blob that is below said each blob. The apex is detected by identification of a predetermined number of adjacent blobs, in which each blob is below any existing adjacently preceding blob within the predetermined number of adjacent blobs. As an example, the direction reflects whether the sports projectile, such as the golf ball, initially rises continuously and then, e.g. after an apex, such as a climax, highest position or the like, continuously falls downwards until it hits the ground. Bouncing may occur after the ground has been hit depending on visibility and/or whether fairway, bunker or ruff is at the landing position. As an example, the direction sub-score calculation may be split into two parts, i.e. a first part and a second part. In the first part, i.e. before apex, each blob that is below the blob after it contributes to a high score and each blob that is above the blob after it contributes to a low score. In the second part, i.e. after apex, the scoring is reversed with high score for falling blobs and low scores for rising blobs.

As mentioned, the gradually decreasing size of the set of blobs assigned to said each trace may be generated based on that a respective size of each blob decreases, or generally decreases, towards an end of said each trace. The gradually decreasing size may reflect that the traced sports projectile, such as the golf ball, is moving away from the tracking sensor. As an example, this sub-score is awarded a high score when blobs at the start of the trace become smaller and smaller in size the further along the trace you get. If the blobs instead get bigger and bigger a low score is awarded.

As mentioned, the length of said each trace may be generated based on a summation of distances between the blobs of said each trace. The length sub-score reflects a total distance in the image from the beginning to the currently last blob of the trace. As an example, the length sub-score is awarded a high score if the total distance in an image frame that the trace covers is long and a low score if the distance is short.

As mentioned, the blob count of said each trace may be generated based on a count of the blobs forming said each trace. The blob count may reflect how many blobs the trace is built up by. As an example, the blob count sub-score is awarded a high score for traces with many blobs in them, i.e. traces that have been going, such as monitored, on for a long time, and a low score to traces with few blobs. Again, the blob count may or may not be normalized, e.g. among the set of monitored traces.

In the examples above, traces with high scores will be more likely to contribute with a blob that will be kept, or filtered in, and next e.g. sent in action A170. However, in other examples, the scoring may be different, e.g. such that traces with low scores will be more likely to contribute with a blob that will be kept, and next e.g. sent in action A170.

Notably, other sub-scores may be applied in addition to those mentioned above without departing from the scope as defined by the appended independent claims.

Action A126

The video management system 100 can select, e.g. by the capturing subsystem 110, a subset of selected traces from among the set of traces. Each selected trace of the subset of selected traces has the respective score that is among most extreme scores, such as maximum scores, minimum scores or the like, of the set of scores.

As mentioned, in some examples, the most extreme scores can be any score that satisfies, e.g. is greater than, is less than or the like, a threshold value. The threshold value can be absolute or relative, e.g. as a percentage of the most extreme score, or the like. A relative threshold can be set based on a standard deviation for a distribution depicting the set of scores, e.g. n multiplied by the standard deviation, where n can be 1, 2, 3, 4 . . . , etc. by choice for the specific case.

Generally, the highest or lowest score can be selected depending on implementation details, e.g. whether "high" or "low" is associated with scores that are probable to relate to an actual ball. Summarizing, among the most extreme scores can refer to a maximum score, a minimum score, scores that satisfies a threshold as explained above, a top number of scores, e.g. the top three scores, the top four scores etc., a bottom number of scores, e.g. the bottom/least three scores, the bottom/least four scores etc., The subset of selected traces may include less than a particular number of traces. The particular number may be predetermined or dynamically determined based on e.g. bandwidth available between the capturing subsystem 110 and the rendering subsystem 120. The particular number may be less than 50, 30, 20, 10, 5, or the like.

Action A128

The video management system 100 can obtain, by the capturing subsystem 110, a subset of last blobs based on the subset of selected traces. In this manner, the video management system 100 e.g. selects the subset of blobs from among the set of blobs. E.g. each selected blob of the subset of selected blobs is the aforementioned each last blob that was assigned to a respective selected trace of the subset of selected traces in action A122.

As an example, this may mean that the subset of last blobs comprises each respective last blob of the subset of selected traces. Clearly, the set of last blobs comprises the subset of last blobs.

In view of the above, as an example, for each tracking image frame a new set of blobs is received and assigned to one or more traces if possible. If a blob does not belong to any trace, a new trace is created with that blob as the first blob. The score for each updated, or newly created, trace is calculated and the latest blobs from the best X traces are selected to be kept. These latest blobs can be sent to the rendering subsystem 120 later on. The best X traces may be those with the highest or lowest respective score depending on chosen scoring, i.e. whether high implies keep or discard etc. X may be a fixed number, such as 3, 4, 5 etc. or a dynamic number according to e.g. available bandwidth. In this manner, the capturing subsystem 110 filters out blobs that are not probable to pertain to a tracked golf ball. Expressed differently, the capturing subsystem 110 filters in blobs that are likely to belong to a tracked golf ball.

In some examples, the video management system 100 also provide, by the capturing subsystem 110, the subset of last blobs already in this action. As an example, the video management system 100 may thus send the subset of last blobs to the rendering subsystem 120, e.g. similarly to as in action A170.

Action A130

Occasionally, for at least some of said each tracking image frames, the video management system 100 may compress, by the capturing subsystem 110, at least one of the tracking image frames into a calibration frame. The capturing subsystem 110 may use a lossless or lossy compression algorithm for the purpose of compressing said at least one of the tracking image frames into the calibration frame. The calibration frame may be used by the rendering subsystem 120 to determine a coordinate transformation between a broadcast coordinate system of the video camera 113 and a tracking coordinate system of the tracking sensor 115. The compressing A130 of said at least one of the tracking image frames into the calibration frame may be triggered every nth second, such as every 10 ms, every 100 ms, every 500 ms or the like.

The calibration frame has a compression ratio that maintains a resolution of the calibration frame above a threshold value such that calibration is achievable, e.g. by the rendering subsystem 120. The compression ratio can be at least two, at least four, at least five, or at least ten, or the like. Generally, the compression ratio may be calculated as an original image size divided by a compressed image size.

Action A140

The video management system 100 transforms, by the capturing subsystem 110, the set of blobs and/or optionally the calibration frame, or as the case may be the subset of selected blobs and/or the calibration frame, into a binary signal. As an example, the transformation of the set of blobs and/or the calibration frame into the binary signal may be performed regularly, e.g. at a predetermined frequency, or irregularly. The predetermined frequency may be 25, 29.97, 50 Hz or the like, such as for each frame of the tracking stream, for each set of traces, for each subset of selected traces, for each video frame captured in action A150 or the like. Sometimes, the calibration frame is not transformed into a binary signal in order for available bandwidth to be used for transfer of the set of blobs. The binary signal can have two levels, "0" and "1", where data of the set of blobs is modulated onto a carrier wave. As an example, 8 000 Hz may represent "0" and 16 000 Hz may represent "1" or vice versa. In this example, a bit rate of 8 kbits/s may thus be obtained, since at least one period of the lowest of the two frequencies above will be required for one bit to be represented. The binary signal may thus carry information about the set of blobs in the form of a binary audio signal. Each blob may comprise image data and optionally radar data as the case may be. It shall be noted that the optional filtering of blobs implies that less data is required. Accordingly, less bandwidth would be required for a transfer, such as in action A170.

Action A150

The video management system 100 captures, by the video camera 113, a video stream, comprising video frames. Expressed differently, the video camera 113 of the video management system 100 may capture the video stream. In more detail, the video frames may comprise image frames. The video stream may comprise one or more audio streams, or audio channels, according to known manners.

Action A160

The video management system 100 embeds, by the capturing subsystem 110, the binary signal in an audio channel of the video stream. As an example, this may mean that the audio channel of the video stream is populated with the data of the subset of select blobs and/or the calibration frame.

Action A170

The video management system 100 sends, by the transmitter 117, the set of blobs to the rendering subsystem 120 that is configured to use the set of blobs for rendering one or more tracking traces to be presented on the output unit 129, i.e. multiple sets of blobs from different frames will be required to build said one or more tracking traces. This means e.g. that for each tracking image frame the set of blobs are transmitted, where the blobs in the set can belong to different traces. In particular, this means that the set of blobs does not build up a specific trace.

In some embodiments, the video management system 100 sends, by the transmitter 117, the video stream. The video stream may include the set of blobs, and optionally the calibration frame, of the binary signal included in the video stream, to the rendering subsystem 120.

The set of blobs and/or the calibration frame may be transmitted, e.g. by the capturing subsystem 110, using the audio channel for the video stream. The channel can have a very limited bandwidth, but of course if the channel has a broader bandwidth than required, the channel simply allows for transfer of any other further data should it be needed. The channel is in this example an audio channel. The channel is carried on in the video stream on the RF link.

In some examples, this action may follow after action A128.

Action B110

Subsequent to action A170, the video management system 100 receives, e.g. by the rendering subsystem 120, the set of blobs from the transmitter 117.

In some embodiments, the video management system 100 may receive, by the rendering subsystem 120, the video stream from the capturing subsystem 110. In more detail, the set of blobs and/or the video stream may be received by the receiver 127 of the rendering subsystem 120.

Action B120

The video management system 100 extracts, by the rendering subsystem 120, the embedded set of blobs and/or optionally the calibration frame from the audio channel of the video stream. The rendering subsystem 120 decodes the set of blobs of the audio channel, e.g. by doing the inverse, or opposite, procedure as compared to what was performed by the capturing subsystem 110 in e.g. action A140. As an example, the capturing subsystem 110 and the rendering subsystem 120 uses an encoder and a decoder of the same coding scheme.

Action B130

The video management system 100 generates, by the rendering subsystem 120, a tracking trace based on the set of blobs by applying a tracking trace generation procedure that selects one trace that is most probably corresponds to an actual trajectory of the tracked sports projectile. Again, the tracking trace generation procedure may be using one or more known techniques for tracking traces, e.g. alone or in combination with each other.

Action B140

The video management system 100 can calibrate, by the rendering subsystem 120, coordinate systems C1, C2 of the video camera 113 and the tracking sensor 115 based on at least the calibration frame 210 and a video frame related to the calibration frame 210 to obtain a coordinate transformation CT1 to 2. The calibration between the coordinate system C1, C2 of the video camera 113 and the tracking sensor 115 may also be performed according to known procedures, e.g. using measurements in combination with trigonometric calculations.

Action B150

In order for the tracking trace to be rendered correctly in the video frames of the video stream, the video management system 100 transforms, by the rendering subsystem 120, the tracking trace to the coordinate system C1 of the video camera 113 using the coordinate transformation obtained in action B140.

Action B160

The video management system 100 can render, by the rendering subsystem 120, at least a portion of the transformed tracking trace in the video frames.

Action B170

The video management system 100 can provide, by the rendering subsystem 120, at least one of said one or more tracking traces for rendering by the output unit 129. The providing in action B170, e.g. the provision in the present action, may comprise sending the rendered video frames to the output unit 129. In this manner, a viewer of the rendered video frames may get an enhanced experience thanks to the tracking trace rendered in the video frames.

Figure 3:
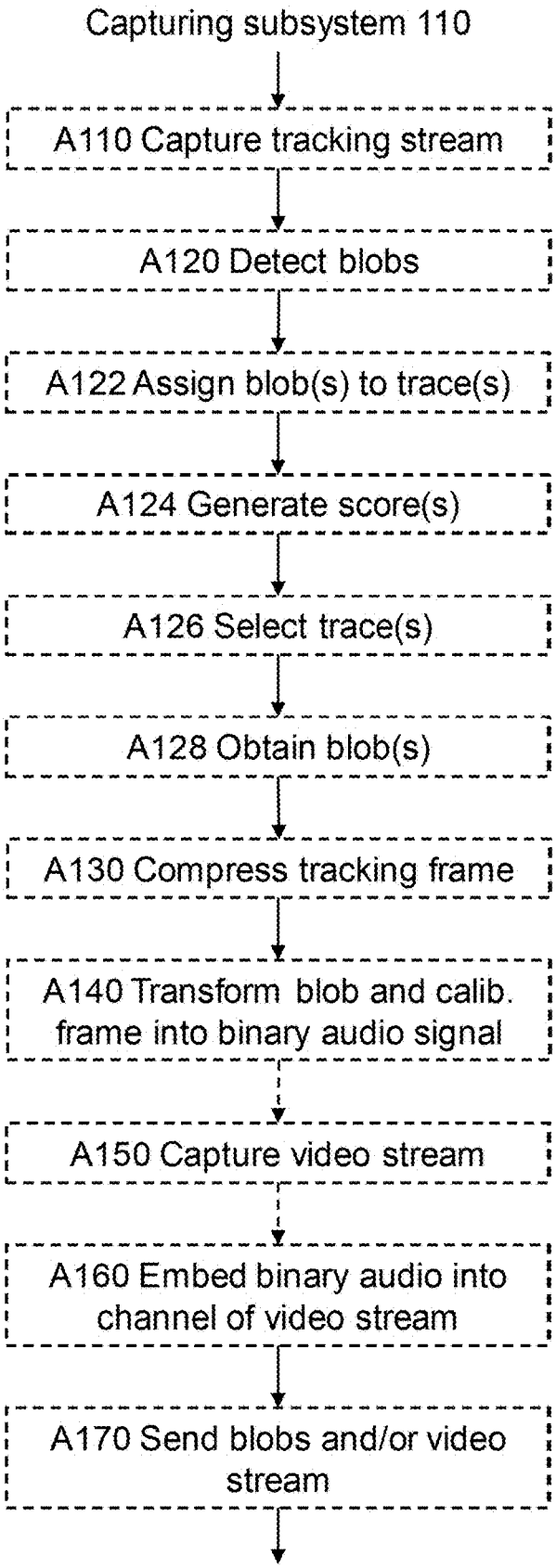
FIG. 3 is another flowchart illustrating embodiments of the method herein, e.g. performed by the capturing subsystem.

In FIG. 3, a schematic flowchart of exemplifying methods in the capturing subsystem 110 is shown. Again, the same reference numerals as above have been used to denote the same or similar features, in particular the same reference numerals have been used to denote the same or similar actions. The actions below are the same or similar as those described above with reference to FIG. 2*a* and/or FIG. 2*b*. Accordingly, the capturing subsystem 110 performs a method for managing blobs and optionally a calibration frame or providing blobs.

As an example, the capturing sub-system 110 may perform a method for managing a set of blobs, such as last blobs. Further, in some examples, the capturing sub-system 110 may perform a method for managing a video stream.

One or more of the following actions may be performed in any suitable order.

Action A110

The capturing subsystem 110 can capture, e.g. by means of the tracking sensor 115, a tracking stream. The tracking stream comprises tracking image frames. The tracking sensor 115 may comprise a video recording device and optionally a radar device (not shown). The video recording device and/or the radar device may be configured to capture the tracking stream.

The method further comprises, e.g. for each tracking image frame, one or more of action A120-B170 according to various examples:

Action A120

The capturing subsystem 110 can detect a set of last blobs for said each tracking image frame by applying a blob detection procedure to said each tracking image frame and, i.e. in addition to said each tracking image frame, one or more further tracking image frames of the tracking stream. Said each tracking image frame is subsequent to said one or more further tracking image frames. The set of last blobs can comprise at least two last blobs.

Action A122

For each last blob of the set of last blobs, the capturing subsystem 110 can assign said each last blob to one or more traces, thereby obtaining a set of traces after assignment of all of the last blobs of the set of last blobs. The set of traces comprises said one or more traces assigned to said each last blob, whereby the set of traces can comprise at least two traces.

Action A124

In order to filter out at least some of the set of traces, the capturing subsystem 110 can generate a respective score for each trace of the set of traces based on one or more of:

- a start location of said each trace, such as a start location sub-score or the like,
- an initial straightness of said each trace, such as an initial straightness sub-score or the like,
- an acceleration of said each trace, such as an acceleration sub-score or the like,
- a direction of said each trace, such as a direction sub-score or the like,
- a gradually decreasing size of blobs assigned to said each trace, such as a gradually decreasing size sub-score or the like,
- a length of said each trace, such as a length sub-score or the like,
- a blob count of said each trace, such as a blob count sub-score or the like,
- or the like,
- or a combination thereof.

In some embodiments, the generating A124, by the capturing subsystem 110, of the respective score for each trace of the set of traces is based on the start location of said each trace.

In some embodiments, the generating A124, by the capturing subsystem 110, of the respective score for each trace of the set of traces is based on the initial straightness of said each trace.

In some embodiments, the generating A124, by the capturing subsystem 110, of the respective score for each trace of the set of traces is based on the acceleration of said each trace.

In some embodiments, the generating A124, by the capturing subsystem 110, of the respective score for each trace of the set of traces is based on the direction of said each trace.

In some embodiments, the generating A124, by the capturing subsystem 110, of the respective score for each trace of the set of traces is based on the direction of said each trace.

In some embodiments, the generating A124, by the capturing subsystem 110, of the respective score for each trace of the set of traces is based on the gradually decreasing size of blobs assigned to said each trace.

In some embodiments, the generating A124, by the capturing subsystem 110, of the respective score for each trace of the set of traces is based on the length of said each trace.

In some embodiments, the generating A124, by the capturing subsystem 110, of the respective score for each trace of the set of traces is based on the blob count of said each trace.

Action A126

The capturing subsystem 110 can select a subset of selected traces from among the set of traces. Each selected trace of the subset of selected traces has the respective score that is among most extreme scores, such as maximum scores, minimum scores or the like, of the set of scores.

Action A128

The capturing subsystem 110 can obtain a subset of last blobs based on the subset of selected traces. In this manner, the video management system 100 e.g. selects the subset of blobs from among the set of blobs, wherein e.g. each selected blob of the subset of selected blobs is the aforementioned each blob that was assigned to a respective selected trace of the subset of selected traces in action A122.

Action A130

Occasionally, for at least some of said each tracking image frames, the capturing subsystem 110 may compress at least one of the tracking image frames into a calibration frame. The calibration frame may be used by the rendering subsystem to determine a coordinate transformation between a broadcast coordinate system of the video camera 113 and a tracking coordinate system of the tracking sensor 115.

The compressing A130 of said at least one of the tracking image frames into the calibration frame may be triggered every nth second, such as every 10 ms, every 100 ms, every 500 ms or the like.

The calibration frame has a compression ratio that maintains a resolution of the calibration frame above a threshold value such that calibration is achievable. The compression ratio can be at least two, at least four, at least five, at least ten, or the like. Generally, the compression ratio may be calculated as an original image size divided by a compressed image size.

Action A140

The capturing subsystem 110 may transform the subset of selected blobs and/or the calibration frame into a binary signal for carrying audio data, e.g. at a predetermined frequency.

Action A150

In some embodiments, the capturing subsystem 110 may capture, by the video camera 113, a video stream, comprising video frames. Expressed differently, the video camera 113 of the video management system 100 may capture the video stream. In more detail, the video frames may comprise image frames.

Action A160

The capturing subsystem 110 may embed the binary signal in an audio channel of the video stream. As an example, this may mean that the audio channel of the video stream is populated with the data of the subset of select blobs and/or the calibration frame.

Action A170

The capturing subsystem 110 may send, e.g. by the transmitter 117, the subset of selected last blobs to the rendering subsystem 120. This means e.g. that for each tracking image frame the subset of last blobs are transmitted, where the last blobs in the subset are expected to belong to different traces. In particular, it may mean that no trace built up by the subset of last blobs that was transmitted.

Figure 4:
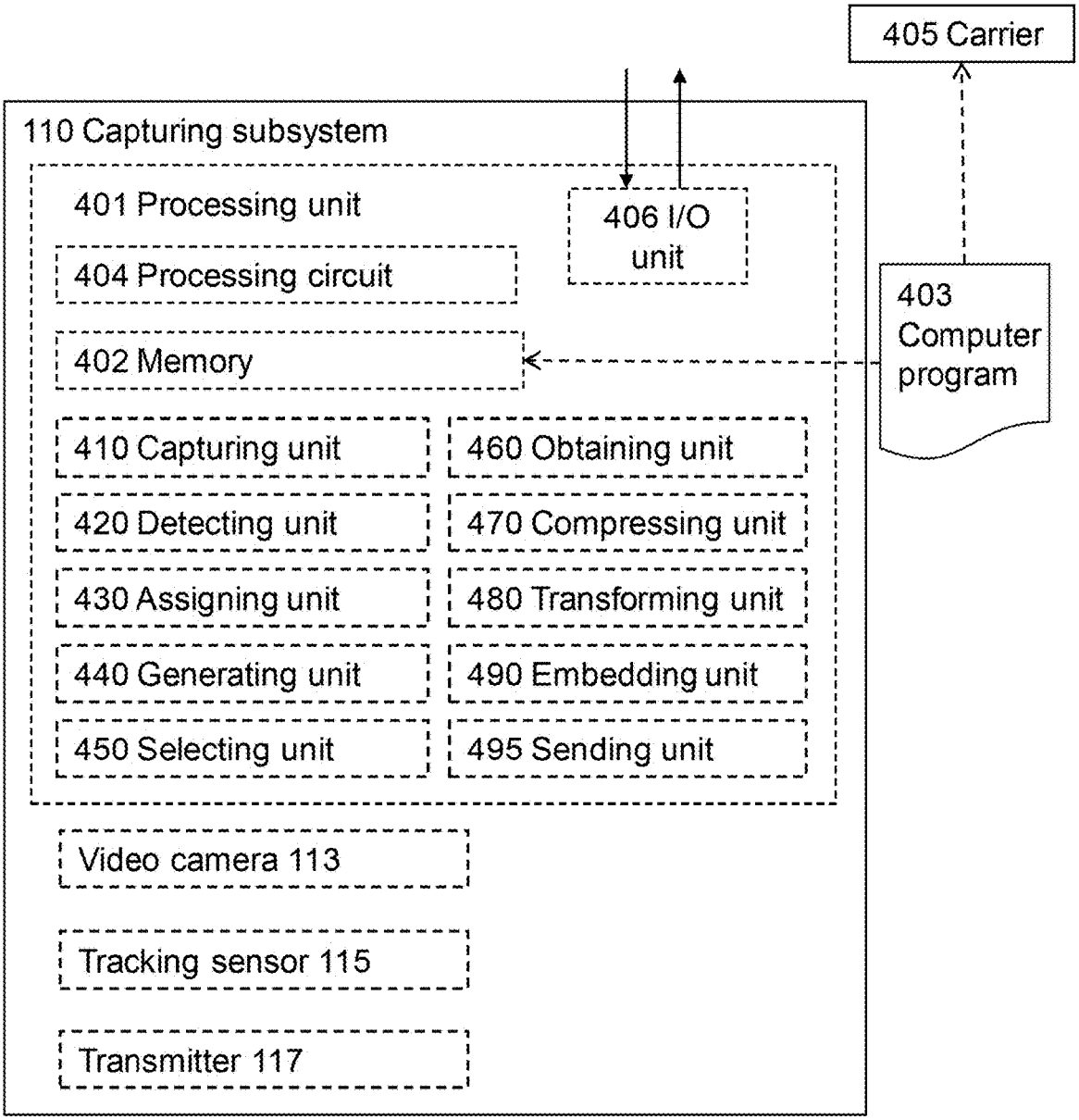
FIG. 4 is a block diagram illustrating embodiments of the capturing subsystem.

With reference to FIG. 4, a schematic block diagram of embodiments of the capturing subsystem 110 of FIG. 1*a* and/or FIG. 1*b* is shown.

The capturing subsystem 110 may comprise a processing unit 401, which can perform the methods described herein. The means may be embodied in the form of one or more hardware units and/or one or more software units. The term "unit" may thus refer to a circuit, a software block or the like according to various embodiments as described below.

The capturing subsystem 110 may further comprise a memory 402. The memory may comprise, such as contain or store, instructions, e.g. in the form of a computer program 403, which may comprise computer readable code units.

According to some embodiments herein, the capturing subsystem 110 and/or the processing unit 401 comprises a processing circuit 404 as an exemplifying hardware unit, which may comprise one or more processors. Accordingly, the processing unit 401 may be embodied in the form of, or 'realized by', the processing circuit 404. The instructions may be executable by the processing circuit 404, whereby the capturing subsystem 110 is operative to perform the methods of FIG. 2*a* and/or FIG. 2*b* and/or FIG. 3. As another example, the instructions, when executed by the capturing subsystem 110 and/or the processing circuit 404, may cause the capturing subsystem 110 to perform the method according to FIG. 2 a and/or FIG. 2*b* and/or FIG. 3.

In view of the above, in some examples, there is provided a capturing subsystem 110. Again, the memory 402 contains the instructions executable by said processing circuit 404 whereby the capturing subsystem 110 can be operative for:

capturing, by the tracking sensor 115, a tracking stream, which comprises tracking image frames, and wherein the capturing subsystem 110 is configured for, for each tracking image frame:

detecting a set of last blobs for said each tracking image frame by applying a blob detection procedure to said each tracking image frame and one or more further tracking image frames of the tracking stream, wherein said each tracking image frame is subsequent to said one or more further tracking image frames. The set of last blobs can comprise at least two last blobs, for each last blob of the set of last blobs, assigning (A122), by the capturing subsystem (110), said each last blob to one or more traces, thereby obtaining a set of traces after assignment of all of the last blobs of the set of last blobs, wherein the set of traces comprises said one or more traces assigned to said each last blob, whereby the set of traces can comprise at least two traces, generating a respective score for each trace of the set of traces based on one or more of:

a start location of said each trace, an initial straightness of said each trace, an acceleration of said each trace, a direction of said each trace, a gradually decreasing size of blobs assigned to said each trace, a length of said each trace, and a blob count of said each trace, or the like, or a combination thereof, selecting a subset of selected traces from the set of traces, wherein each selected trace of the subset of selected traces has the respective score that is among most extreme scores of the set of scores, and obtaining a subset of last blobs based on the subset of selected traces.

FIG. 4 further illustrates a carrier 405, or program carrier, which provides, such as comprises, mediates, supplies and the like, the computer program 403 as described directly above. The carrier 405 may be one of an electronic signal, an optical signal, a radio signal and a computer readable medium.

In some embodiments, the capturing subsystem 110 and/or the processing unit 401 may comprise one or more of a capturing unit 410, a detecting unit 420, an assigning unit 430, a generating unit 440, a selecting unit 450, an obtaining unit 460, a compressing unit 470, a transforming unit 480, an embedding unit 490 and a sending unit 495 as exemplifying hardware units. The term "unit" may refer to a circuit when the term "unit" refers to a hardware unit. In other examples, one or more of the aforementioned exemplifying hardware units may be implemented as one or more software units.

Moreover, the capturing subsystem 110 and/or the processing unit 401 may comprise an Input/Output unit 406, which may be exemplified by the receiving unit and/or the sending unit when applicable. The capturing subsystem 110 may also comprise the video camera 113, the tracking sensor 115 and the transmitter 117. The transmitter 117 may be an example of the Input/Output unit 406 and/or sending unit as applicable.

Accordingly, the capturing subsystem 110 is configured for providing blobs. As an example, the capturing subsystem 110 is configured for managing a set of last blobs.

Therefore, according to the various embodiments described above, the capturing subsystem 110 and/or the processing unit 401 and/or the capturing unit 410 can be configured for capturing, by the tracking sensor 115, a tracking stream, which comprises tracking image frames.

The capturing subsystem 110 and/or the processing unit 401 and/or the detecting unit 420 can be configured for, for each tracking image frame, detecting, by the capturing subsystem 110, a set of last blobs for said each tracking image frame by applying a blob detection procedure to said each tracking image frame and one or more further tracking image frames of the tracking stream. Said each tracking image frame is subsequent to said one or more further tracking image frames. The set of last blobs can comprise at least two last blobs.

The capturing subsystem 110 and/or the processing unit 401 and/or the assigning unit 430 can be configured for assigning, by the capturing subsystem 110 and for each last blob of the set of last blobs, said each last blob to one or more traces, thereby obtaining a set of traces after assignment of all of the last blobs of the set of blobs, wherein the set of traces comprises said one or more traces assigned to said each last blob, whereby the set of traces can comprise at least two traces.

The capturing subsystem 110 and/or the processing unit 401 and/or the generating unit 440 can be configured for generating, by the capturing subsystem 110, a respective score for each trace of the set of traces based on one or more of:

a start location of said each trace,
an initial straightness of said each trace,
an acceleration of said each trace,
a direction of said each trace,
a gradually decreasing size of blobs assigned to said each trace,
a length of said each trace,
a blob count of said each trace, or
the like, or
a combination thereof.

The capturing subsystem 110 and/or the processing unit 401 and/or the selecting unit 450 can be configured for selecting, by the capturing subsystem 110, a subset of selected traces from among the set of traces. Each selected trace of the subset of selected traces has the respective score that is among most extreme max/min scores of the set of scores.

The capturing subsystem 110 and/or the processing unit 401 and/or the obtaining unit 460 can be configured for obtaining, by the capturing subsystem 110, a subset of last blobs based on the subset of selected traces.

The start location of said each trace may be generated based on a position in the tracking image frame of the first blob in said each trace.

The initial straightness of said each trace may be generated based on a comparison between an aggregated stepwise distance for a sequence of blobs of said each trace and a linear distance between the first and the last blob of said each trace.

The acceleration of said each trace may be generated based a comparison of stepwise distances between a sequence of blobs.

The direction of said each trace may be generated based on 1) for blobs before apex of said trace, that each blob has an adjacently following blob that is above said each blob, and based on 2) for blobs after apex of said trace, that each blob has an adjacently following blob that is below said each blob. The apex is detected by identification of a predetermined number of adjacent blobs, in which each blob is below any existing adjacently preceding blob within the predetermined number of adjacent blobs.

The gradually decreasing size of the set of blobs assigned to said each trace may be generated based on that a respective size of each blob decreases, or generally decreases, towards an end of said each trace.

The length of said each trace may be generated based on a summation of distances between the blobs of said each trace.

The blob count of said each trace may be generated based on a count of the blobs forming said each trace.

In some examples, the capturing subsystem 110 comprises a video camera 113.

The capturing subsystem 110 and/or the processing unit 401 and/or the compressing unit 470 may be configured for compressing at least one of the tracking image frames into a calibration frame.

The capturing subsystem 110 and/or the processing unit 401 and/or the transforming unit 480 may be configured for transforming the subset of selected blobs and/or the calibration frame into a binary signal for carrying audio data, e.g. at a predetermined frequency.

The capturing subsystem 110 and/or the processing unit 401 and/or the capturing unit 410, or another capturing unit (not shown), may be configured for capturing, e.g. by the video camera 113, a video stream, comprising video frames.

The capturing subsystem 110 and/or the processing unit 401 and/or the embedding unit 490 may be configured for embedding the binary signal in an audio channel of the video stream.

The capturing subsystem 110 and/or the processing unit 401 and/or the sending unit 495 may be configured for sending, e.g. by the transmitter 117, the video stream, including the blob data and the calibration frame of the binary signal embedded into the video stream, to the rendering subsystem 120 that can be configured to use the subset of selected last blobs for rendering one or more tracking traces to be presented on the output unit 129.

Figure 5:
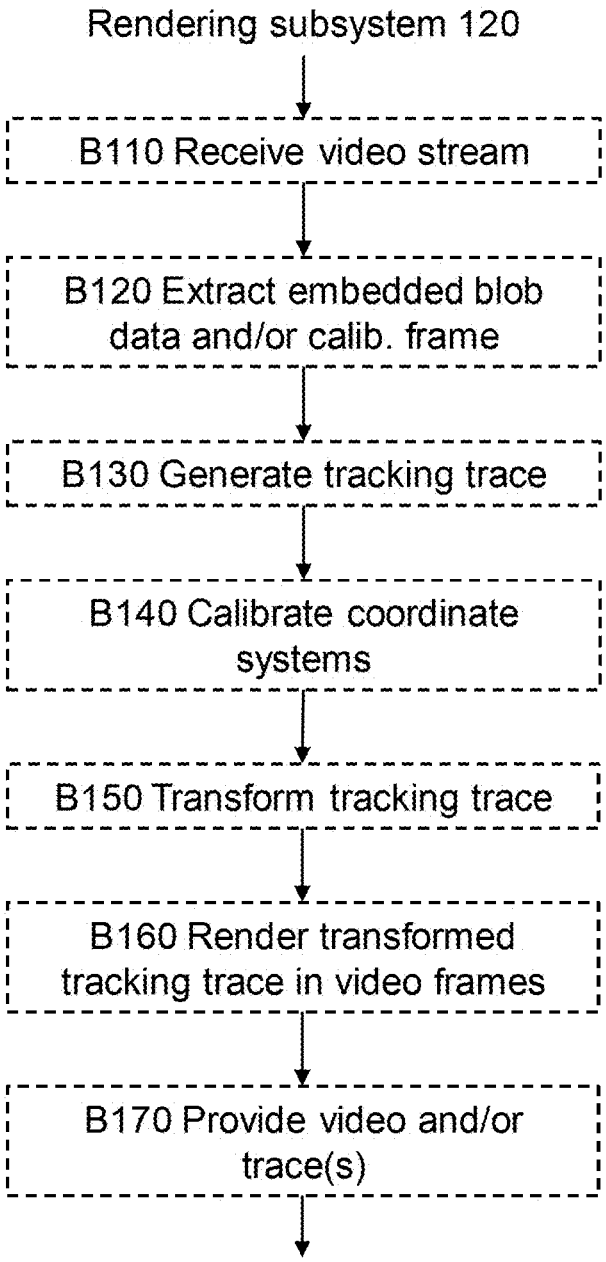
FIG. 5 is a further flowchart illustrating embodiments of the method herein, e.g. performed by the rendering subsystem.

In FIG. 5, a schematic flowchart of exemplifying methods in the rendering subsystem 120 is shown. Again, the same reference numerals as above have been used to denote the same or similar features, in particular the same reference numerals have been used to denote the same or similar actions. In some examples, the rendering subsystem 120 performs a method for managing a video stream. In some examples, the rendering subsystem 120 performs a method for managing a set of blobs, such as last blobs.

One or more of the following actions may be performed in any suitable order.

Action B110

Subsequent to action A170, the rendering subsystem 120 can receive the subset of last blobs from the transmitter 117, e.g. from the capturing subsystem 110 in the video stream.

Action B120

The rendering subsystem 120 may extract the embedded subset of selected blobs and/or the calibration frame from the audio channel of the video stream, e.g. based on the predetermined frequency.

Action B130

The rendering subsystem 120 can generate a tracking trace based on the subset of last blobs by applying a tracking trace generation procedure that selects one trace that is most probably corresponds to an actual trajectory of the tracked sports projectile.

Action B140

The rendering subsystem 120 may calibrate coordinate systems C1, C2 of the video camera 113 and the tracking sensor 115 based on at least the calibration frame 210 and a video frame related to the calibration frame 210 to obtain a coordinate transformation CT1 to 2.

Action B150

In order for the tracking trace to be rendered correctly in the video frames of the video stream, the rendering subsystem 120 may transform the tracking trace to the coordinate system C1 of the video camera 113 using the coordinate transformation obtained in action B140.

Action B160

The rendering subsystem 120 may render at least a portion of the transformed tracking trace in the video frames.

Action B170

The rendering subsystem 120 can provide at least one of said one or more tracking traces for rendering by the output unit 129. The providing B170 may comprise sending the rendered video frames to the output unit 129, such as a display, a broadcasting device etc.

Figure 6:
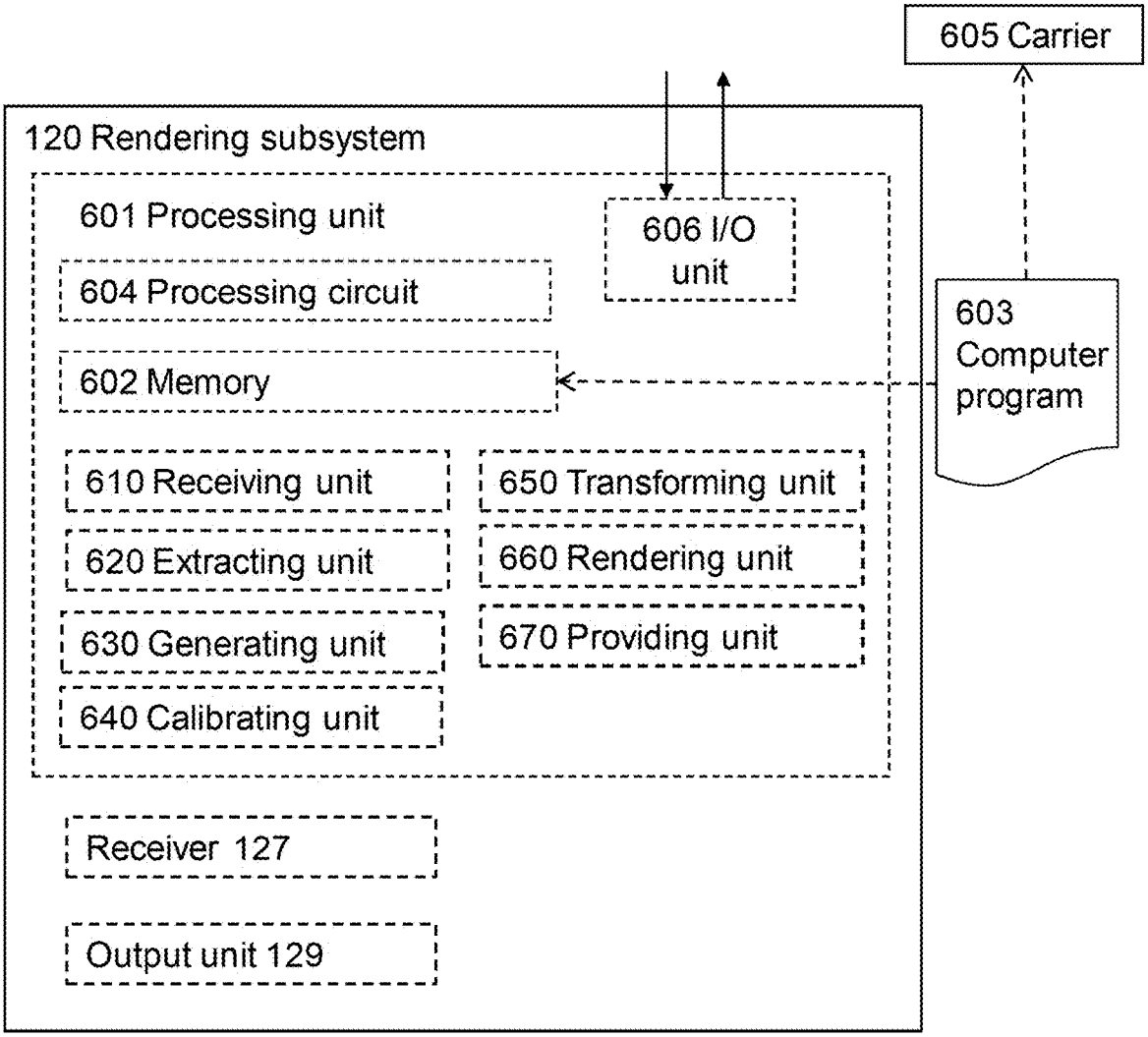
FIG. 6 is another block diagram illustrating embodiments of the rendering subsystem.

With reference to FIG. 6, a schematic block diagram of embodiments of the rendering subsystem 120 of FIG. 1 is shown.

The rendering subsystem 120 may comprise a processing unit 601, which can perform the methods described herein. The processing unit 601 may be embodied in the form of one or more hardware units and/or one or more software units. The term "unit" may thus refer to a circuit, a software block or the like according to various embodiments as described below.

The rendering subsystem 120 may further comprise a memory 602. The memory may comprise, such as contain or store, instructions, e.g. in the form of a computer program 603, which may comprise computer readable code units.

According to some embodiments herein, the rendering subsystem 120 and/or the processing unit 601 comprises a processing circuit 604 as an exemplifying hardware unit. Accordingly, the processing unit 601 may be embodied in the form of, or 'realized by', the processing circuit 604. The instructions may be executable by the processing circuit 604, whereby the rendering subsystem 120 is operative to perform the methods of FIG. 2*a* and/or FIG. 2*b* and/or FIG. 5. As another example, the instructions, when executed by the rendering subsystem 120 and/or the processing circuit 604, may cause the rendering subsystem 120 to perform the method according to FIG. 2*a* and/or FIG. 2*b* and/or FIG. 5.

In view of the above, in one example, there is provided a rendering subsystem 120. Again, the memory 602 contains the instructions executable by said processing circuit 604 whereby the rendering subsystem 120 is operative for:

- receiving the video stream from the capturing subsystem 110,
- extracting the embedded subset of selected blobs and/or the calibration frame from the audio channel of the video stream,
- calibrating coordinate systems C1, C2 of the video camera 113 and the tracking sensor 115 based on at least the calibration frame 210 and a video frame related to the calibration frame 210 to obtain a coordinate transformation CT1 to 2,
- transforming the tracking trace to the coordinate system C1 of the video camera 113 using the coordinate transformation,
- rendering at least a portion of the transformed tracking trace in the video frames,
- wherein the rendering subsystem 120 can be configured for providing by sending the rendered video frames to the output unit 129.

FIG. 6 further illustrates a carrier 605, or program carrier, which provides, such as comprises, mediates, supplies and the like, the computer program 603 as described directly above. The carrier 605 may be one of an electronic signal, an optical signal, a radio signal and a computer readable medium.

In further embodiments, the rendering subsystem 120 and/or the processing unit 601 may comprise one or more of a receiving unit 610, an extracting unit 620, a generating unit 630, a calibrating unit 640, a transforming unit 650, a rendering unit 660, and a providing unit 670 as exemplifying hardware units. The term "unit" may refer to a circuit when the term "unit" refers to a hardware unit. In other examples, one or more of the aforementioned exemplifying hardware units may be implemented as one or more software units.

Moreover, the rendering subsystem 120 and/or the processing unit 601 may comprise an Input/Output unit 606, which may be exemplified by the receiving unit and/or the sending unit when applicable. As mentioned before, the rendering subsystem 120 may comprise a receiver 127 and an output unit 129. The I/O unit 606 may comprise the receiver 127.

Accordingly, the rendering subsystem 120 can be configured for managing a video stream. In some examples, the rendering subsystem 120 can be configured for managing a set of last blobs.

Therefore, according to the various embodiments described above, the rendering subsystem 120 and/or the processing unit 601 and/or the receiving unit 610 may be configured for receiving, by the rendering subsystem 120, the video stream from the capturing subsystem 110.

The rendering subsystem 120 and/or the processing unit 601 and/or the extracting unit 620 may be configured for extracting, by the rendering subsystem 120, the embedded subset of selected blobs and/or the calibration frame from the audio channel of the video stream, e.g. based on the predetermined frequency.

The rendering subsystem 120 and/or the processing unit 601 and/or the calibrating unit 640 may be configured for calibrating, by the rendering subsystem 120, coordinate systems C1, C2 of the video camera 113 and the tracking sensor 115 based on at least the calibration frame 210 and a video frame related to the calibration frame 210 to obtain a coordinate transformation CT1 to 2.

The rendering subsystem 120 and/or the processing unit 601 and/or the transforming unit 650 may be configured for transforming, by the rendering subsystem 120, the tracking trace to the coordinate system C1 of the video camera 113 using the coordinate transformation.

The rendering subsystem 120 and/or the processing unit 601 and/or the rendering unit 660 may be configured for rendering, by the rendering subsystem 120, at least a portion of the transformed tracking trace in the video frames.

The rendering subsystem 120 and/or the processing unit 601 and/or the providing unit 670 may be configured for providing by sending the rendered video frames to the output unit 129.

In some embodiments, the rendering subsystem 120 can be configured for compressing said at least one of the tracking image frames into the calibration frame every nth second, such as every 10 ms, every 100 ms, every 500 ms, or the like.

In some embodiments, the calibration frame has a compression ratio that maintains a resolution of the calibration frame above a threshold value such that calibration is achievable. The compression ratio can be at least two, at least four, at least five, at least ten, or the like.

In some embodiments, the transmitter 117 comprises a wireless transmitter configured for wireless transfer of data to a wireless receiver, an RF-transmitter, or a fiber-optic transmitter. The receiver 127 comprises a wireless receiver configured for wireless reception of data from a wireless transmitter, an RF-receiver or a fiber-optic receiver.

It can be noted that a radar and/or a lidar can output data in a format that is analogous to pixels, especially when used for imaging purposes. This data is often referred to as radar images, radar maps, or the like. The data can sometimes be referred to as a point cloud in two or three dimensions, where each point can represent an observation, or a pixel. A pixel or observation, in this context, can thus refer to intensity, signal strength, azimuth, elevation, phase, distance, etc.

As used herein, the term "unit" may refer to one or more functional units, each of which may be implemented as one or more hardware units and/or one or more software units and/or a combined software/hardware unit in a node. In some examples, the unit may represent a functional unit realized as software and/or hardware of the node.

As used herein, the term "computer program carrier", "program carrier", or "carrier", may refer to one of an electronic signal, an optical signal, a radio signal, and a computer readable medium. In some examples, the computer program carrier may exclude transitory, propagating signals, such as the electronic, optical and/or radio signal. Thus, in these examples, the computer program carrier may be a non-transitory carrier, such as a non-transitory computer readable medium.

As used herein, the term "processing unit" may include one or more hardware units, one or more software units or a combination thereof. Any such unit, be it a hardware, software or a combined hardware-software unit, may be a determining means, estimating means, capturing means, associating means, comparing means, identification means, selecting means, receiving means, sending means or the like as disclosed herein. As an example, the expression "means" may be a unit corresponding to the units listed above in conjunction with the Figures.

As used herein, the term "software unit" may refer to a software application, a Dynamic Link Library (DLL), a software component, a software module, a software object, a React component, an object according to Component Object Model (COM), a software function, a software engine, an executable binary software file or the like.

The terms "processing unit" or "processing circuit" may herein comprise one or more processors, an Application Specific Integrated Circuit (ASIC), a Field-Programmable Gate Array (FPGA) or the like. The processing circuit or the like may comprise one or more processor kernels.

As used herein, the expression "configured to/for" can refer to that a processing circuit can be configured to, such as adapted to or operative to, by means of software configuration and/or hardware configuration, perform one or more of the actions described herein.

As used herein, the term "action" may refer to an action, a step, an operation, a response, a reaction, an activity or the like. It shall be noted that an action herein may be split into two or more sub-actions as applicable. Moreover, also as applicable, it shall be noted that two or more of the actions described herein may be merged into a single action.

As used herein, the term "memory" may refer to a hard disk, a magnetic storage medium, a portable computer diskette or disc, flash memory, random access memory (RAM) or the like. Furthermore, the term "memory" may refer to an internal register memory of a processor or the like.

As used herein, the term "computer readable medium" may be a Universal Serial Bus (USB) memory, a Digital Versatile Disc (DVD), a Blu-ray disc, a software unit that is received as a stream of data, a Flash memory, a hard drive, a memory card, such as a MemoryStick, a Multimedia Card (MMC), Secure Digital (SD) card, etc. One or more of the aforementioned examples of computer readable medium may be provided as one or more computer program products.

As used herein, the term "computer readable code units" may be text of a computer program, parts of or an entire binary file representing a computer program in a compiled format or anything there between.

Any feature disclosed for one example and/or embodiment may be combined with one or more features disclosed for one or more other examples and/or embodiments without departing from the scope herein.

EXAMPLES

1. A method, performed by a capturing subsystem (110), for providing blobs, wherein the capturing subsystem (110) comprises a tracking sensor (115), wherein the method comprises:
   capturing (A110), by the tracking sensor (115), a tracking stream, which comprises tracking data maps, and
   wherein the method comprises, for each tracking data map:
   detecting (A120), by the capturing subsystem (110), a set of last blobs for said each tracking data map by applying a blob detection procedure to said each tracking data map and one or more further tracking data maps of the tracking stream, wherein said each tracking data map is subsequent to said one or more further tracking data maps,
   for each last blob of the set of last blobs, assigning (A122), by the capturing subsystem (110), said each last blob to one or more traces, thereby obtaining a set of traces after assignment of all of the last blobs of the set of last blobs, wherein the set of traces comprises said one or more traces assigned to said each last blob,
   generating (A124), by the capturing subsystem (110), a respective score for each trace of the set of traces based on one or more of:
   a start location of said each trace,
   an initial straightness of said each trace,
   an acceleration of said each trace,
   a direction of said each trace,
   a gradually decreasing size of blobs assigned to said each trace,
   a length of said each trace,
   a blob count of said each trace, or
   a combination thereof,
   selecting (A126), by the capturing subsystem (110), a subset of selected traces from the set of traces, wherein each selected trace of the subset of selected traces has the respective score that is among most extreme scores of the set of scores, and
   obtaining (A128), by the capturing subsystem (110), a subset of last blobs based on the subset of selected traces by preferably selecting the subset of last blobs from among the set of last blobs, wherein preferably each last blob of the subset of last blobs was assigned to a respective selected trace of the subset of selected traces.
2. The method according to Example 1, wherein the generating (A124), by the capturing subsystem (110), of the respective score for each trace of the set of traces is based on:
   the start location of said each trace, wherein preferably the start location reflects how low, in a tracking data map, a first blob of a trace is located.
3. The method according to any one of the preceding Examples, wherein the generating (A124), by the capturing subsystem (110), of the respective score for each trace of the set of traces is based on:
   the initial straightness of said each trace, wherein preferably the initial straightness of said each trace is generated based on a comparison between an aggregated stepwise distance for a sequence of blobs of said each trace and a linear distance between the first and the last blob of said each trace.

4. The method according to any one of the preceding Examples, wherein the generating (A124), by the capturing subsystem (110), of the respective score for each trace of the set of traces is based on:

the acceleration of said each trace, wherein preferably the acceleration of said each trace is generated based a comparison of stepwise distances between a sequence of blobs, wherein the acceleration is awarded a high score if said each trace is slowing down and the acceleration is awarded a low score If said each trace is speeding up.

5. The method according to any one of the preceding Examples, wherein the generating (A124), by the capturing subsystem (110), of the respective score for each trace of the set of traces is based on:

the direction of said each trace, wherein preferably the direction of said each trace is generated based on 1) for blobs before apex of said trace, that each blob has an adjacently following blob that is above said each blob, and based on 2) for blobs after apex of said trace, that each blob has an adjacently following blob that is below said each blob.

6. The method according to any one of the preceding Examples, wherein the generating (A124), by the capturing subsystem (110), of the respective score for each trace of the set of traces is based on:

the gradually decreasing size of blobs assigned to said each trace, wherein preferably the gradually decreasing size of the set of blobs assigned to said each trace is generated based on that a respective size of each blob decreases towards an end of said each trace.

7. The method according to any one of the preceding Examples, wherein the generating (A124), by the capturing subsystem (110), of the respective score for each trace of the set of traces is based on:

the length of said each trace, wherein preferably the length of said each trace is generated based on a summation of distances between blobs of said each trace.

8. The method according to any one of the preceding Examples, wherein the generating (A124), by the capturing subsystem (110), of the respective score for each trace of the set of traces is based on:

the blob count of said each trace, wherein preferably the blob count of said each trace is generated based on a count of the blobs forming said each trace.

9. The method according to any one of the preceding Examples, wherein the capturing subsystem (110) is comprised in a video management system (100), wherein the video management system (100) comprises a rendering subsystem (120), wherein the capturing subsystem (110) comprises a transmitter (117), wherein the rendering subsystem (120) comprises an output unit (129), wherein the method comprises:

sending (A170), by the transmitter (117), the subset of selected last blobs to the rendering subsystem (120) that is configured to use the subset of selected last blobs for rendering one or more tracking traces to be presented on the output unit (129).

10. The method according to the preceding Examples, wherein the method comprises:

receiving (B110), by the rendering subsystem (120), the subset of last blobs from the transmitter (117), generating (B130), by the rendering subsystem (120), said one or more tracking traces based on the subset of last blobs by applying a tracking trace generation procedure, and providing (B170), by the rendering subsystem (120), at least one of said one or more tracking traces for rendering by the output unit (129).

11. The method according to the preceding Example, wherein the capturing subsystem (110) comprises a video camera (113), wherein the method comprises:

compressing (A130), by the capturing subsystem (110), at least one of the tracking data maps into a calibration data map, transforming (A140), by the capturing subsystem (110), the subset of selected blobs and/or the calibration data map into a binary signal for carrying audio data, capturing (A150), by the video camera (113), a video stream, comprising video frames, embedding (A160), by the capturing subsystem (110), the binary signal in an audio channel of the video stream, sending (A170), by the transmitter (117), the video stream to the rendering subsystem (120), receiving (B110), by the rendering subsystem (120), the video stream from the capturing subsystem (110), extracting (B120), by the rendering subsystem (120), the embedded subset of selected blobs and/or the calibration data map from the audio channel of the video stream, calibrating (B140), by the rendering subsystem (120), coordinate systems (C1, C2) of the video camera (113) and the tracking sensor (115) based on at least the calibration data map (210) and a video frame related to the calibration data map (210) to obtain a coordinate transformation (CT1 to 2), transforming (B150), by the rendering subsystem (120), the tracking trace to the coordinate system (C1) of the video camera (113) using the coordinate transformation, rendering (B160), by the rendering subsystem (120), at least a portion of the transformed tracking trace in the video frames, and wherein the providing (B170) comprises sending the rendered video frames to the output unit (129).

12. A method, performed by a capturing subsystem (110), for managing a set of last blobs, wherein the method comprises the actions of the capturing subsystem (110) according to any one of Examples 1-11.

13. A capturing subsystem (110) configured for providing blobs, wherein the capturing subsystem (110) comprises a tracking sensor (115), wherein the capturing subsystem (110) is configured for:

capturing, by the tracking sensor (115), a tracking stream, which comprises tracking data maps, and wherein the video management system (100) is configured for, for each tracking data map:

detecting, by the capturing subsystem (110), a set of last blobs for said each tracking data map by applying a blob detection procedure to said each tracking data map and one or more further tracking data maps of the tracking stream, wherein said each tracking data map is subsequent to said one or more further tracking data maps, assigning (A122), for each last blob of the set of last blobs and by the capturing subsystem (110), said each last blob to one or more traces, thereby obtaining a set of traces after assignment of all of the last blobs of the set of last blobs, wherein the set of traces comprises said one or more traces assigned to said each last blob, generating, by the capturing subsystem (110), a respective score for each trace of the set of traces based on one or more of:

a start location of said each trace, an initial straightness of said each trace, an acceleration of said each trace, a direction of said each trace, a gradually decreasing size of blobs assigned to said each trace, a length of said each trace, a blob count of said each trace, or a combination thereof, selecting, by the capturing subsystem (110), a subset of selected traces from the set of traces, wherein each selected trace of the subset of selected traces has the respective score that is among the most extreme scores of the set of scores, and obtaining, by the capturing subsystem (110), a subset of last blobs based on the subset of selected traces by preferably selecting the subset of last blobs from among the set of last blobs, wherein preferably each last blob of the subset of last blobs was assigned to a respective selected trace of the subset of selected traces.

14. A computer program (403), comprising computer readable code units which when executed on a capturing subsystem (110) causes the capturing subsystem (110) to perform the method according to any one of Examples 1-12.

15. A carrier (405) comprising the computer program according to the preceding Example, wherein the carrier (405) is one of an electronic signal, an optical signal, a radio signal and a computer readable medium.

The invention claimed is:

1. A method, performed by a video management system, for providing blobs, wherein the video management system comprises a capturing subsystem, wherein the capturing subsystem comprises a tracking sensor, wherein the method comprises:

capturing, by the tracking sensor, a tracking stream, which comprises tracking image frames, and maintaining, by the capturing subsystem, a set of maintained traces, and wherein the method comprises, for each tracking image frame:

detecting, by the capturing subsystem, a set of last blobs for said each tracking image frame by applying a blob detection procedure to said each tracking image frame and one or more further tracking image frames of the tracking stream, wherein said each tracking image frame is subsequent to said one or more further tracking image frames, for each last blob of the set of last blobs, assigning, by the capturing subsystem, said each last blob to one or more traces of the set of maintained traces, thereby updating the set of maintained traces after assignment of all of the last blobs of the set of last blobs, generating, by the capturing subsystem, a respective score for each trace of the set of maintained traces based on one or more of:

a start location of said each trace, an initial straightness of said each trace, an acceleration of said each trace, a direction of said each trace, a gradually decreasing size of blobs assigned to said each trace, a length of said each trace, a blob count of said each trace, or a combination thereof, selecting, by the capturing subsystem, a subset of selected traces from the set of maintained traces, wherein each selected trace of the subset of selected traces has the respective score that is among most extreme scores of the set of scores, obtaining, by the capturing subsystem, a subset of last blobs based on the subset of selected traces, generating, by the capturing subsystem, a calibration frame based on at least one of the tracking image frames, transforming, by the capturing subsystem, the subset of selected last blobs and/or the calibration frame into a binary signal for carrying audio data, capturing, by the video camera, a video stream, comprising video frames, embedding, by the capturing subsystem, the binary signal in an audio channel of the video stream, sending, by the transmitter, the video stream to the rendering subsystem, receiving, by the rendering subsystem, the video stream from the capturing subsystem, extracting, by the rendering subsystem, the embedded subset of selected blobs and/or the calibration frame from the audio channel of the video stream, calibrating, by the rendering subsystem, coordinate systems of the video camera and the tracking sensor based on at least the calibration frame and a video frame related to the calibration frame, transforming, by the rendering subsystem, the tracking trace to the coordinate system of the video camera, and rendering, by the rendering subsystem, at least a portion of the transformed tracking trace in the video frames.

2. The method according to claim 1, wherein the generating, by the capturing subsystem, of the respective score for each trace of the set of maintained traces is based on the length of said each trace, such that the selecting selects a first trace over a second trace when the first trace is longer than the second trace.

3. The method according to claim 2, wherein the generating, by the capturing subsystem, of the respective score for each trace of the set of maintained traces is based on the start location of said each trace.

4. The method according to claim 2, wherein the generating, by the capturing subsystem, of the respective score for each trace of the set of maintained traces is based on the initial straightness of said each trace.

5. The method according to claim 2, wherein the generating, by the capturing subsystem, of the respective score for each trace of the set of maintained traces is based on the acceleration of said each trace.

6. The method according to claim 2, wherein the generating, by the capturing subsystem, of the respective score for each trace of the set of maintained traces is based on the direction of said each trace.

7. The method according to claim 1, wherein the generating, by the capturing subsystem, of the respective score for each trace of the set of maintained traces is based on the blob count of said each trace, such that the selecting selects a first trace over a second trace when the first trace has a higher blob count than the second trace.

8. The method according to claim 7, wherein the generating, by the capturing subsystem, of the respective score for each trace of the set of maintained traces is based on the gradually decreasing size of blobs assigned to said each trace.

9. The method according to claim 1, wherein the rendering subsystem comprises an output unit, and wherein the rendering subsystem is configured to use the subset of selected last blobs for rendering one or more tracking traces to be presented on the output unit.

10. The method according to claim 9, wherein the method comprises:

receiving, by the rendering subsystem, the subset of last blobs from the transmitter, generating, by the rendering subsystem, said one or more tracking traces based on the subset of last blobs by applying a tracking trace generation procedure, and providing, by the rendering subsystem, at least one of said one or more tracking traces for rendering by the output unit.

11. The method according to claim 10, wherein the capturing subsystem comprises a video camera, wherein the method comprises:

compressing, by the capturing subsystem, at least one of the tracking image frames into a calibration frame, transforming, by the capturing subsystem, the subset of selected blobs and/or the calibration frame into a binary signal for carrying audio data, capturing, by the video camera, a video stream, comprising video frames, embedding, by the capturing subsystem, the binary signal in an audio channel of the video stream, sending, by the transmitter, the video stream to the rendering subsystem, receiving, by the rendering subsystem, the video stream from the capturing subsystem, extracting, by the rendering subsystem, the embedded subset of selected blobs and/or the calibration frame from the audio channel of the video stream, calibrating, by the rendering subsystem, coordinate systems of the video camera and the tracking sensor based on at least the calibration frame and a video frame related to the calibration frame to obtain a coordinate transformation, transforming, by the rendering subsystem, the tracking trace to the coordinate system of the video camera using the coordinate transformation, rendering, by the rendering subsystem, at least a portion of the transformed tracking trace in the video frames, and wherein the providing comprises sending the rendered video frames to the output unit.

12. A video management system configured for to provide blobs, wherein the video management system comprises a capturing subsystem, wherein the capturing subsystem comprises a tracking sensor, wherein the video management system is configured to perform operations comprising: capturing, by the tracking sensor, a tracking stream, which comprises tracking image frames, and maintaining, by the capturing subsystem, a set of maintained traces, and wherein the operations comprise, for each tracking image frame: detecting, by the capturing subsystem, a set of last blobs for said each tracking image frame by applying a blob detection procedure to said each tracking image frame and one or more further tracking image frames of the tracking stream, wherein said each tracking image frame is subsequent to said one or more further tracking image frames, assigning, for each last blob of the set of last blobs and by the capturing subsystem, said each last blob to one or more traces of the set of maintained traces, thereby updating the set of maintained traces after assignment of the set of last blobs, generating, by the capturing subsystem, a respective score for each trace of the set of maintained traces based on one or more of:

start location of said each trace, an initial straightness of said each trace, an acceleration of said each trace, a direction of said each trace, a gradually decreasing size of blobs assigned to said each trace, a length of said each trace, a blob count of said each trace, or a combination thereof, selecting, by the capturing subsystem, a subset of selected traces from the set of maintained traces, wherein each selected trace of the subset of selected traces has the respective score that is among the most extreme scores of the set of scores, obtaining, by the capturing subsystem, a subset of last blobs based on the subset of selected traces, capturing, by the video camera, a video stream, comprising video frames, embedding, by the capturing subsystem, the subset of selected last blobs as a binary signal in an audio channel of the video stream, sending, by the transmitter, the video stream to the rendering subsystem, receiving, by the rendering subsystem, the video stream from the capturing subsystem, extracting, by the rendering subsystem, the embedded subset of selected blobs from the audio channel of the video stream, generating, by the rendering subsystem, one or more tracking traces based on the extracted subset of last blobs, calibrating, by the rendering subsystem, a coordinate system of the video camera rendering, by the rendering subsystem, at least a portion of one or more tracking traces in the video frames based on the calibrated coordinate system of the camera.

13. The video management system of claim 12, wherein the generating, by the capturing subsystem, of the respective score for each trace of the set of maintained traces is based on the length of said each trace and based on the blob count of said each trace, such that the selecting selects a first trace over a second trace when the first trace is longer than the second trace, the first trace has a higher blob count than the second trace, or both.

14. The video management system of claim 13, wherein the generating, by the capturing subsystem, of the respective score for each trace of the set of maintained traces is based on the start location of said each trace and based on the initial straightness of said each trace.

15. The video management system of claim 14, wherein the generating, by the capturing subsystem, of the respective score for each trace of the set of maintained traces is based on the acceleration of said each trace.

16. The video management system of claim 15, wherein the generating, by the capturing subsystem, of the respective score for each trace of the set of maintained traces is based on the direction of said each trace and based on the gradually decreasing size of blobs assigned to said each trace.

17. The video management system of claim 12, wherein the rendering subsystem comprises an output unit, and wherein the rendering subsystem is configured to use the subset of selected last blobs for rendering one or more tracking traces to be presented on the output unit.

18. The video management system of claim 17, wherein the operations comprise:

receiving, by the rendering subsystem, the subset of last blobs from the transmitter, generating, by the rendering subsystem, said one or more tracking traces based on the subset of last blobs by applying a tracking trace generation procedure, and providing, by the rendering subsystem, at least one of said one or more tracking traces for rendering by the output unit.

19. A video management system configured for providing blobs, wherein the video management system comprises a capturing subsystem, wherein the capturing subsystem comprises a tracking sensor and a video camera, wherein the video management system is configured to perform operations comprising:

capturing, by the tracking sensor, a tracking stream, which comprises tracking image frames, wherein the video management system is configured for, for each tracking image frame:

detecting, by the capturing subsystem, a set of last blobs for said each tracking image frame by applying a blob detection procedure to said each tracking image frame and one or more further tracking image frames of the tracking stream, wherein said each tracking image frame is subsequent to said one or more further tracking image frames, assigning, for each last blob of the set of last blobs and by the capturing subsystem, said each last blob to one or more traces, thereby obtaining a set of traces after assignment of all of the last blobs of the set of last blobs, wherein the set of traces comprises said one or more traces assigned to said each last blob, generating, by the capturing subsystem, a respective score for each trace of the set of traces based on one or more of:

a start location of said each trace, an initial straightness of said each trace, an acceleration of said each trace, a direction of said each trace, a gradually decreasing size of blobs assigned to said each trace, a length of said each trace, a blob count of said each trace, or a combination thereof, selecting, by the capturing subsystem, a subset of selected traces from the set of traces, wherein each selected trace of the subset of selected traces has the respective score that is among the most extreme scores of the set of scores, and obtaining, by the capturing subsystem, a subset of last blobs based on the subset of selected traces, wherein the video management system comprises a rendering subsystem, wherein the capturing subsystem comprises a transmitter, wherein the rendering subsystem comprises an output unit, and wherein the operations comprise:

sending, by the transmitter, the subset of selected last blobs to the rendering subsystem that is configured to use the subset of selected last blobs for rendering one or more tracking traces to be presented on the output unit, wherein the operations comprise:

receiving, by the rendering subsystem, the subset of last blobs from the transmitter, generating, by the rendering subsystem, said one or more tracking traces based on the subset of last blobs by applying a tracking trace generation procedure, and providing, by the rendering subsystem, at least one of said one or more tracking traces for rendering by the output unit, and wherein the operations comprise:

compressing, by the capturing subsystem, at least one of the tracking image frames into a calibration frame, transforming, by the capturing subsystem, the subset of selected blobs and/or the calibration frame into a binary signal for carrying audio data, capturing, by the video camera, a video stream, comprising video frames, embedding, by the capturing subsystem, the binary signal in an audio channel of the video stream, sending, by the transmitter, the video stream to the rendering subsystem, receiving, by the rendering subsystem, the video stream from the capturing subsystem, extracting, by the rendering subsystem, the embedded subset of selected blobs and/or the calibration frame from the audio channel of the video stream, calibrating, by the rendering subsystem, coordinate systems of the video camera and the tracking sensor based on at least the calibration frame and a video frame related to the calibration frame to obtain a coordinate transformation, transforming, by the rendering subsystem, the tracking trace to the coordinate system of the video camera using the coordinate transformation, rendering, by the rendering subsystem, at least a portion of the transformed tracking trace in the video frames, and wherein the providing comprises sending the rendered video frames to the output unit.

* * * * *